US012180631B2

(12) United States Patent
Bagley

(10) Patent No.: US 12,180,631 B2
(45) Date of Patent: Dec. 31, 2024

(54) INDEXABLE, LOCKING HOPPING FOOT

(71) Applicant: Gracewood Management, Inc., West Valley City, UT (US)

(72) Inventor: Jim Matthews Bagley, West Valley City, UT (US)

(73) Assignee: Gracewood Management, Inc., West Jordan, UT (US)

( * ) Notice: Subject to any disclaimer, the term of this patent is extended or adjusted under 35 U.S.C. 154(b) by 10 days.

(21) Appl. No.: 18/183,016

(22) Filed: Mar. 13, 2023

(65) Prior Publication Data

US 2023/0287614 A1 Sep. 14, 2023

Related U.S. Application Data

(60) Provisional application No. 63/269,279, filed on Mar. 14, 2022.

(51) Int. Cl.

| | |
|---|---|
| ***D05B 35/12*** | (2006.01) |
| ***D05B 29/08*** | (2006.01) |
| ***D05B 29/12*** | (2006.01) |

(52) U.S. Cl.
CPC ..... *D05B 35/12* (2013.01); *D05B 29/08* (2013.01); *D05B 29/12* (2013.01)

(58) Field of Classification Search
CPC ..... D05B 35/00; D05B 35/06; D05B 35/12; D05B 29/08; D05B 29/12
See application file for complete search history.

(56) References Cited

U.S. PATENT DOCUMENTS

| | | | | |
|---|---|---|---|---|
| 31,646 A | | 3/1861 | Moulson | |
| 751,057 A | * | 2/1904 | Cooper et al. | D05B 3/02 112/98 |
| 797,308 A | * | 8/1905 | Nassberg | D04D 1/04 112/98 |
| 1,103,836 A | * | 7/1914 | Raplee | D05B 29/06 112/151 |
| 1,431,591 A | * | 10/1922 | Lucy | D05B 21/00 112/102 |

(Continued)

FOREIGN PATENT DOCUMENTS

| | | |
|---|---|---|
| CH | 686681 A5 | 5/1996 |
| CN | 201738111 U | 2/2011 |

(Continued)

OTHER PUBLICATIONS

International Search Report and Written Opinion for International Application No. PCT/US2022/071202, dated Jun. 3, 2022, 12 pages.

(Continued)

*Primary Examiner* — Ismael Izaguirre
(74) *Attorney, Agent, or Firm* — Barnes & Thornburg LLP; Ryan L. Marshall

(57) ABSTRACT

A hopping foot assembly for a sewing machine having a needle comprises a hopping foot base and a hopping foot arm extends axially from the hopping foot base relative to an axis. The hopping foot base is shaped to include an opening that extends axially through the hopping foot base relative to the axis. The hopping foot arm is configured to be coupled to the sewing machine to fix the hopping foot base relative to the sewing machine.

20 Claims, 13 Drawing Sheets

(56) References Cited

U.S. PATENT DOCUMENTS

| | | | | |
|---|---|---|---|---|
| 1,905,907 | A * | 4/1933 | Karle | D05B 91/10 112/121 |
| 1,934,190 | A | 11/1933 | Harker | |
| 2,790,404 | A | 4/1957 | Somers et al. | |
| 5,515,797 | A * | 5/1996 | Janouschek | D05B 29/08 112/235 |
| 5,546,876 | A * | 8/1996 | Schilling | D05B 29/02 112/102.5 |
| 8,234,989 | B2 | 8/2012 | Thomas et al. | |
| 8,453,587 | B2 | 6/2013 | Bagley | |
| 10,407,812 | B2 | 9/2019 | Labes et al. | |
| 10,612,173 | B2 | 4/2020 | Groelz et al. | |
| 2007/0044697 | A1 | 3/2007 | Shomura et al. | |
| 2011/0100276 | A1 * | 5/2011 | Thomas | D05B 11/00 112/117 |
| 2014/0150273 | A1 * | 6/2014 | Bland | D05B 21/00 33/565 |
| 2020/0181820 | A1 | 6/2020 | Mitchell | |

FOREIGN PATENT DOCUMENTS

| | | | |
|---|---|---|---|
| GB | 2505152 | A | 2/2014 |
| WO | 2022198226 | A1 | 9/2022 |

OTHER PUBLICATIONS

Stormshopping, "Multifunctional Daisy Flower Stitch Circles Embroidery Presser Foot for Singer Brother Janome and Other Low Shank Sewing Machine by Stormshopping", 2020, Retrieved from: https://www.amazon.com/Multifunctional-Circles-Embroidery-Presser-Stormshopping/dp/B072LW3W38.

Handi Quilter, Inc., "Handi Quilter Echo Feet Kit", 2020, Retrieved from: https://www.amazon.com/Handi-Quilter-Echo-Feet-Kit/dp/B075R9MW5K.

Brother, "Free Motion Echo Quilting Foot, Brother #XE0766001", 2020, Retrieved from: https://www.sewingpartsonline.com/free-motion-echo-quilting-foot-brother-xe0766001.aspx?gclid=EAIaIQobChMI26WQze-g7AIVjf7jBx1eBwSvEAQYBiABEgLGzvD_BwE.

Johnson, Liz, "Janome Clear View Quilting Foot and Guide Set", Janome, Aug. 21, 2018, Retrieved from: https://sew4home.com/accessories-we-love-clear-view-quilting-foot-and-guide-set-from-janome/.

Martelli Enterprises , "Bella Sedere—Presser Feet Demo" , Retrieved from: https://www.youtube.com/watch?v=he-LInlAoJQ, Uploaded Feb. 17, 2016.

* cited by examiner

INDEXABLE, LOCKING HOPPING FOOT

CROSS-REFERENCE TO RELATED APPLICATIONS

This application claims the benefit of U.S. Provisional Application No. 63/269,279, filed Mar. 14, 2022, the entire contents of which are hereby incorporated by reference.

FIELD OF DISCLOSURE

The present disclosure relates generally to sewing or quilting machines, and more specifically to a hopping foot for sewing and quilting machines.

BACKGROUND

Sewing machines are used for stitching one or more pieces of fabric with thread. Some sewing machines are stationary such that fabric is fed under a needle of the sewing machine, while other sewing machines, like quilting machines, are maneuverable such that the needle may be moved across the fabric.

Maneuverable sewing machines allow a user to create intricate stitching patterns. Maneuverability in such sewing and quilting machines, however, makes it difficult to accurately follow a path on the fabric, such as a seam, a ditch line, or another desired pattern.

A hopping foot and ruler may be used with the sewing machine to help guide the needle along the path. It remains difficult, however, to maneuver the machine and the ruler simultaneously.

SUMMARY

The present disclosure may comprise one or more of the following features and combinations thereof.

A hopping foot assembly for a sewing machine having a needle may comprise a circular hopping foot base, a hopping foot arm that extends axially from the hopping foot base relative to an axis, and a ruler guide. The circular hopping foot base may be shaped to include an outer surface and an inner surface that defines a needle opening that extends axially therethrough relative to the axis to allow the needle to extend into and out of fabric during use of the sewing machine. The hopping foot arm may be configured to be coupled to the sewing machine to fix the hopping foot base relative to the sewing machine. The ruler guide may be coupled to the outer surface of the hopping foot base.

In some embodiments, the ruler guide may be configured to change between an unlocked configuration and a locked configuration. In the unlocked configuration, the ruler guide may be free to rotate about the axis relative to the hopping foot base. In the locked configuration, the ruler guide may be blocked from rotating relative to the hopping foot base so that an orientation of the ruler guide is maintained when the ruler guide is engaged with an edge of a ruler to allow a user to follow a path with the needle of the sewing machine during use of the sewing machine.

In some embodiments, the rotating ruler guide may comprise a bearing coupled to the outer surface of the hopping foot base, a rotating guide attachment coupled to the bearing, and a locking assembly. The bearing may be configured to rotate about the axis. The rotating guide attachment may be configured to engage the edge of the ruler so as to align the needle with the path.

In some embodiments, locking assembly may comprise a lock disk coupled to the hopping foot base, and a locking latch coupled to the guide attachment. The locking latch may be configured to change between a locked position and an unlocked position. In the locked position, the locking latch may mate with the lock disk to block rotation of the guide attachment relative to the hopping foot base. In the unlocked position, the locking latch may be spaced apart from the lock disk to allow rotation of the guide attachment relative to the hopping foot base.

In some embodiments, the lock disk may be shaped to include a plurality of locking teeth. The plurality of locking teeth may define a plurality of disk grooves. The plurality of disk grooves may open radially inward toward the axis.

In some embodiments, the locking latch may be shaped to include a plurality of locking teeth. The plurality of locking teeth may define a plurality of latch grooves. The plurality of latch grooves may open radially outward away from the axis.

In some embodiments, the plurality of locking teeth on lock disk may extend into the plurality of latch grooves and the plurality of locking teeth on the locking latch may extend into the plurality of disk grooves when the locking latch is in the locked position to block rotation of the guide attachment relative to the hopping foot base. In some embodiments, the plurality of locking teeth on the lock disk may be spaced apart circumferentially around the axis.

In some embodiments, the locking assembly may further comprise a bias spring. The bias spring may be arranged between the guide attachment and the locking latch to bias the locking latch toward the locked position.

In some embodiments, the locking latch may comprise a planar body that extends radially relative to the axis a first tab that extends axially from a first side of the planar body, and a second tab that extends axially from a second side of the planar body opposite the first side. The first tab may be shaped to include the plurality of locking teeth. The second tab may be engaged with the bias spring.

In some embodiments, the lock disk may be shaped to include a pointer and the rotating guide attachment may be shaped to include a plurality of angular indicators. The plurality of angular indicators may be configured to be aligned with the pointer of the rotating guide to select a path that extends at a predetermined angle.

In some embodiments, the locking assembly may further comprise a bias spring. The bias spring may be arranged between the guide attachment and the locking latch to bias the locking latch toward the locked position.

In some embodiments, the lock disk may be shaped to include a pointer. The rotating guide attachment may be shaped to include a plurality of angular indicators. The plurality of angular indicators may be configured to be aligned with the pointer of the rotating guide to select a path that extends at a predetermined angle.

In some embodiments, the rotating ruler guide may comprise a lock disk coupled to the hopping foot base, a rotating guide attachment coupled to the lock disk to rotate about the axis, and a locking latch arranged to extend between the guide attachment and the lock disk. The rotating guide attachment may be configured to engage the edge of the ruler so as to align the needle with the path. The locking latch may be configured to change between a locked position and an unlocked position. In the locked position, the locking latch may mate with the lock disk to block rotation of the guide attachment relative to the hopping foot base. In the unlocked position, the locking latch may be spaced apart from the lock disk to allow rotation of the guide attachment relative to the hopping foot base.

In some embodiments, the lock disk may be shaped to include a pointer and the rotating guide attachment may be shaped to include a plurality of angular indicators. The plurality of angular indicators may be configured to be aligned with the pointer of the rotating guide to select a path that extends at a predetermined angle.

In some embodiments, the locking assembly may further comprise a bias spring. The bias spring may be arranged between the guide attachment and the locking latch to bias the locking latch toward the locked position.

According to another aspect of the present disclosure, a hopping foot assembly for a sewing machine having a needle may comprise a hopping foot base, a hopping foot arm that extends axially form the hopping foot base, and a ruler guide coupled to the hopping foot base. The hopping foot base may be shaped to include a needle opening that extends axially therethrough relative to an axis. The hopping foot may be configured to be coupled to the sewing machine to fix the hopping foot base relative to the sewing machine. The ruler guide may be configured to change between an unlocked configuration and a locked configuration. In the unlocked configuration, the ruler guide may be free to rotate about the axis relative to the hopping foot base. In the locked configuration, the ruler guide may be blocked from rotating relative to the hopping foot base.

In some embodiments, the rotating ruler guide may comprise a bearing coupled to the outer surface of the hopping foot base, a rotating guide attachment coupled to the bearing, and a locking assembly. The bearing may be configured to rotate about the axis. The rotating guide attachment may be configured to engage the edge of the ruler so as to align the needle with the path.

In some embodiments, the locking assembly may comprise a lock disk coupled to the hopping foot base and a locking latch coupled to the guide attachment. The locking latch may be configured to change between a locked position and an unlocked position. In the locked position, the locking latch may mate with the lock disk to block rotation of the guide attachment relative to the hopping foot base. In the unlocked position, the locking latch may be spaced apart from the lock disk to allow rotation of the guide attachment relative to the hopping foot base.

In some embodiments, the lock disk may be shaped to include a plurality of locking teeth and the locking latch may be shaped to include a plurality of locking teeth. The plurality of locking teeth on lock disk may engage the plurality of locking teeth on the locking latch when the locking latch is in the locked position to block rotation of the guide attachment relative to the hopping foot base.

In some embodiments, the plurality of locking teeth on lock disk may define a plurality of disk grooves that open radially inward toward the axis. In some embodiments, the plurality of locking teeth on the locking latch may define a plurality of latch grooves that open radially outward away from the axis. The plurality of locking teeth on lock disk may extend into the plurality of latch grooves and the plurality of locking teeth on the locking latch may extend into the plurality of disk grooves when the locking latch is in the locked position. In some embodiments, the plurality of locking teeth on the lock disk may be spaced apart circumferentially around the axis.

In some embodiments, the locking assembly may further comprises a bias spring. The bias spring may be arranged between the guide attachment and the locking latch to bias the locking latch toward the locked position.

In some embodiments, the lock disk may be shaped to include a pointer and the rotating guide attachment may be shaped to include a plurality of angular indicators. The plurality of angular indicators may be configured to be aligned with the pointer of the rotating guide to select a path that extends at a predetermined angle.

In some embodiments, the rotating ruler guide may comprise a lock disk coupled to the hopping foot base, a rotating guide attachment coupled to the lock disk to rotate about the axis, and a locking latch arranged to extend between the guide attachment and the lock disk. The rotating guide attachment may be configured to engage the edge of the ruler so as to align the needle with the path. The locking latch may be configured to change between a locked position and an unlocked position. In the locked position, the locking latch may mate with the lock disk to block rotation of the guide attachment relative to the hopping foot base. In the unlocked position, the locking latch may be spaced apart from the lock disk to allow rotation of the guide attachment relative to the hopping foot base.

These and other features of the present disclosure will become more apparent from the following description of the illustrative embodiments.

DETAILED DESCRIPTION OF THE DRAWINGS

Figure 1:
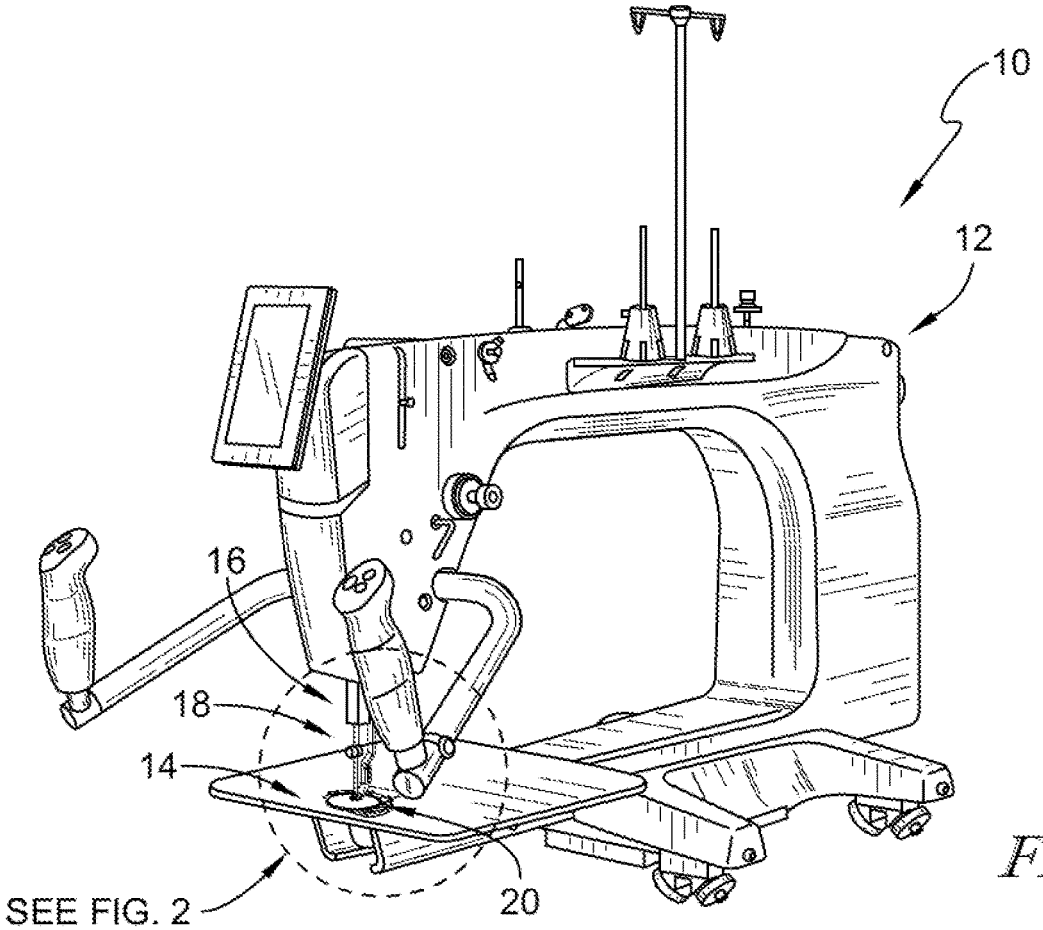
FIG. 1 is a perspective view of a sewing machine with a hopping foot assembly coupled to a presser bar of the sewing machine.

For the purpose of promoting an understanding of the principles of the disclosure, reference will now be made to a number of illustrative embodiments illustrated in the drawings and specific language will be used to describe the same.

Figure 2:
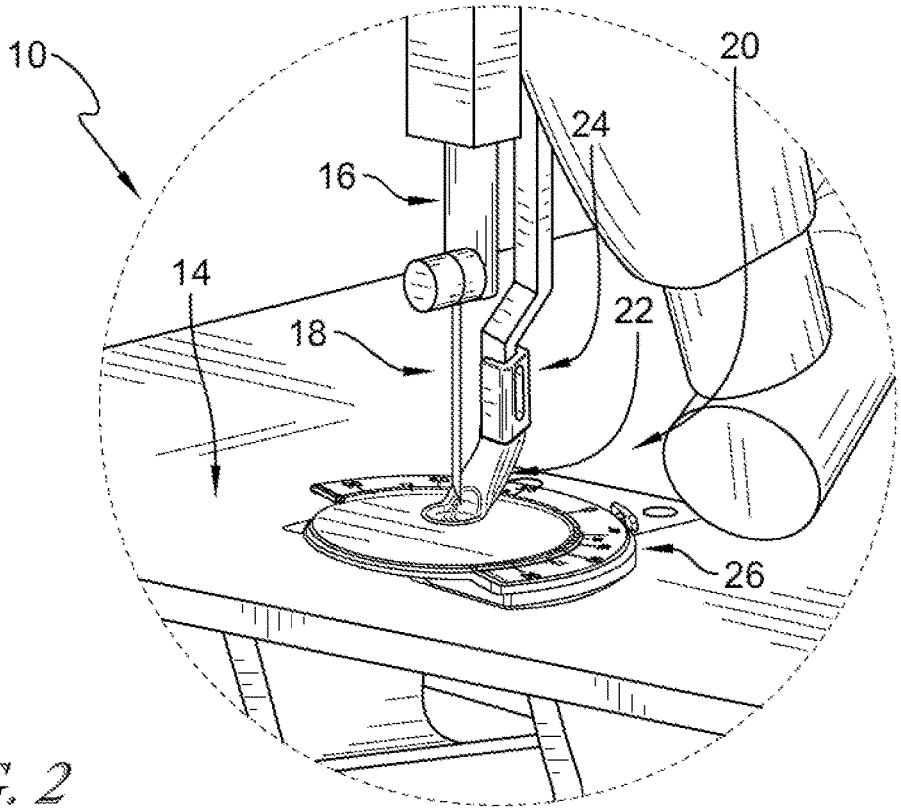
FIG. 2 is a detail view of the sewing machine of FIG. 1 showing the hopping foot assembly that includes a hopping foot base shaped to include an opening that extends axially therethrough relative to an axis of the hopping foot assembly, a hopping foot arm that extends from the hopping foot base and couples to the sewing machine to fix the hopping foot base relative to the sewing machine, and a ruler guide coupled to the hopping foot base that aids a user in aligning a needle of the sewing machine in a path.

A hopping foot assembly 20 adapted for use with a sewing machine 10 is shown in FIGS. 1-10. The sewing machine 10 has a sewing machine body 12, sewing machine bed 14, a presser bar 16, and a needle 18 as shown in FIGS. 1 and 2. The hopping foot assembly 20 is coupled to the presser bar 16 of the sewing machine 10 and configured to be lowered into contact with fabric 19 to be sewn.

The hopping foot assembly 20 includes a hopping foot base 22, a hopping foot arm 24, and a ruler guide 26 as shown in FIGS. 2-7. The hopping foot base 22 is shaped to define a needle opening 23 that extends through the base 22 relative to an axis 28. The needle opening 23 is configured to allow the needle 18 to extend into and out of the fabric 19. The hopping foot arm 24 extends axially from the hopping foot base 22 and couples to the presser bar 16 of the sewing machine 10 to fix the hopping foot base 22 relative to the sewing machine 10. The ruler guide 26 is coupled to the hopping foot base 22 and is configured rotate about the axis 28 relative to the hopping foot base 22.

When sewing or quilting pieces of fabric together, it may be difficult for a user to guide the needle 18 of the machine 10 along a path without straying from the path. The path may be a seam, a ditch line, or another desired stitch pattern to be sewn in the fabric 19. Following the path with the needle 18 is especially difficult for free moving or maneuverable machines, which allow the user to freely move the machine 10 along the path.

Therefore, the user may use a ruler 15 to define the path to be followed by the needle 18 and help guide the hopping foot, and thus the needle 18, along the path. However, it may be difficult to maneuver the machine 10 and maintain the orientation of the ruler 15 simultaneously.

Figure 7:
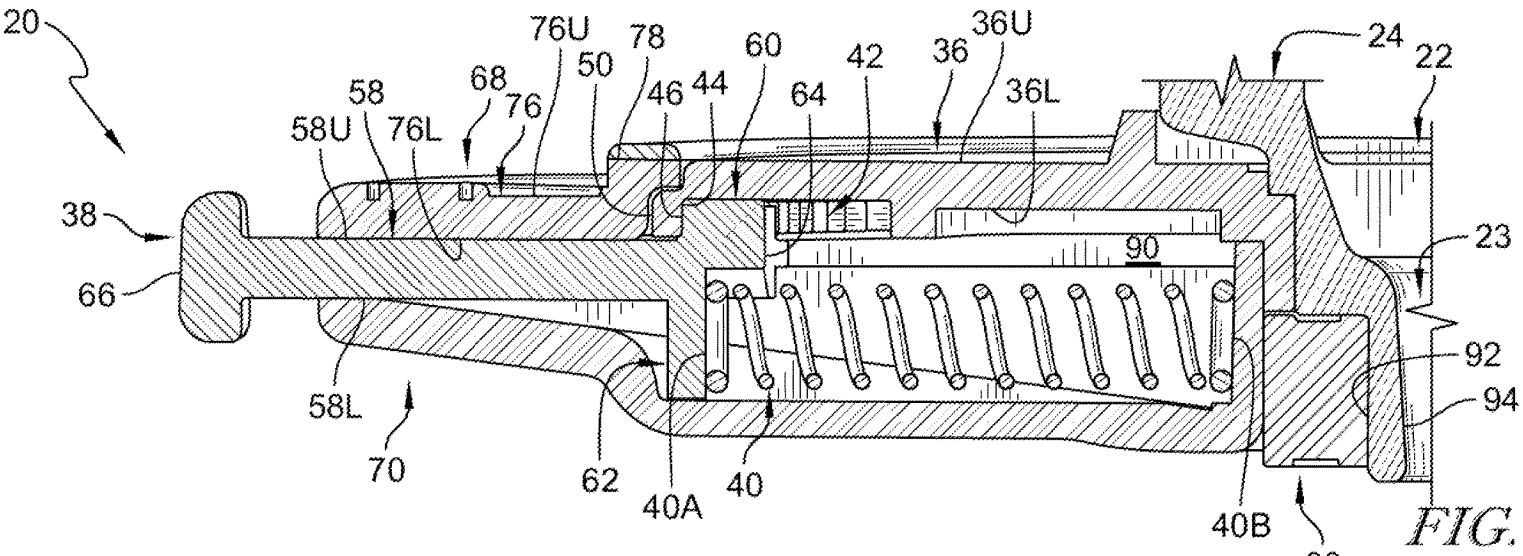
FIG. 7 is a cross-section view of the hopping foot assembly of FIG. 3 showing the ruler guide in the locked configuration such that the locking latch is in a locked position in which the locking latch mates with the locking disk to block rotation of the guide attachment relative to the hopping foot base.
Figure 8:
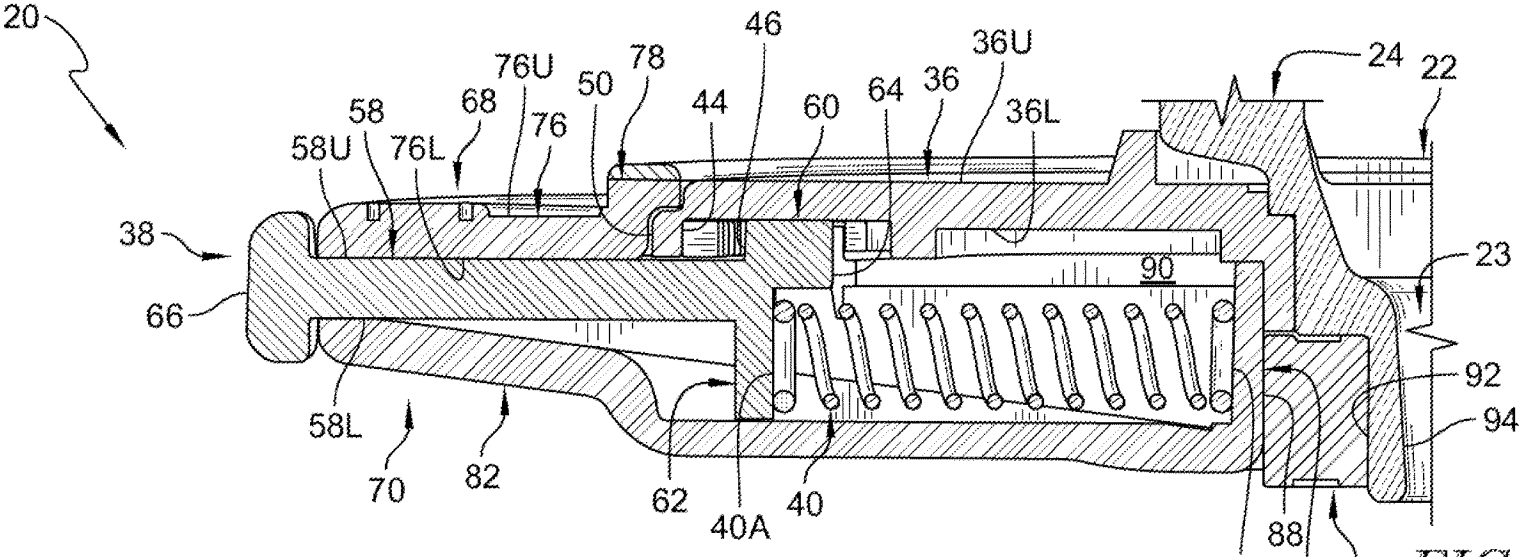
FIG. 8 is a view similar to FIG. 7 showing the ruler guide in the unlocked configuration such that the locking latch is in the unlocked position in which the locking latch is spaced apart from the locking disk to allow rotation of the guide attachment relative to the hopping foot base.
Figure 7A:
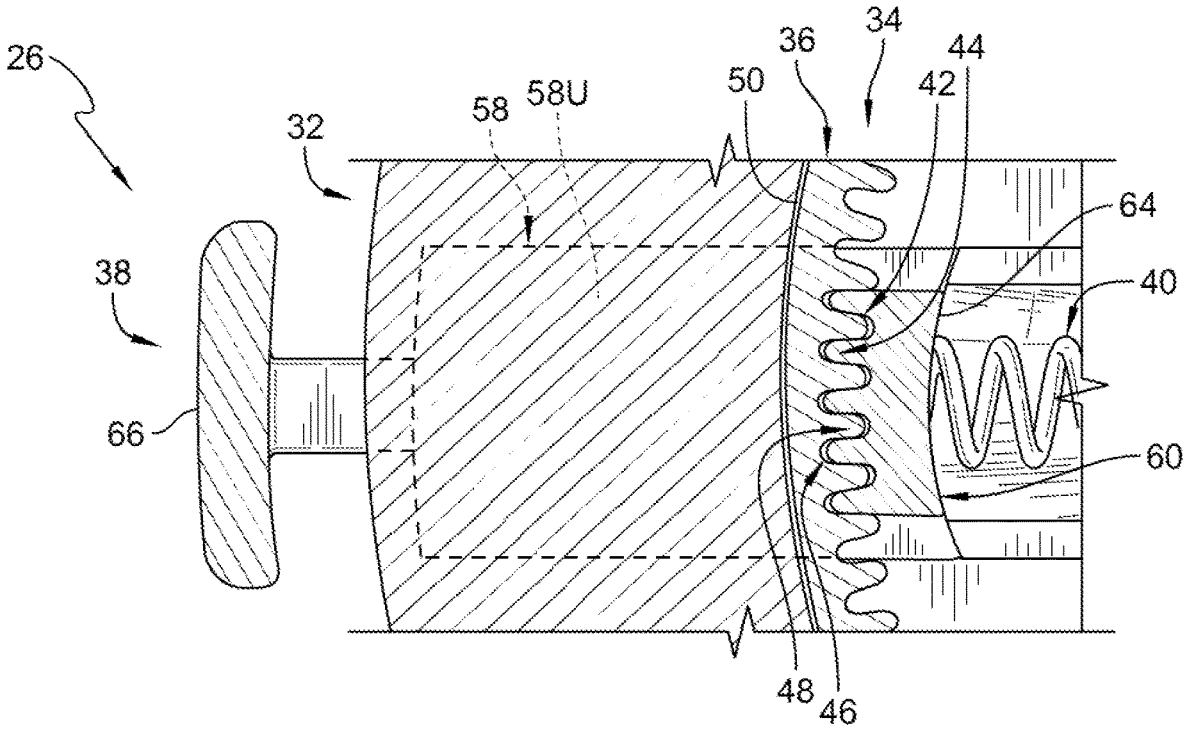
FIG. 7A is cross-section view of the hopping foot assembly of FIG. 7 showing the locking disk is shaped to include a plurality of locking teeth that engage with a plurality of locking teeth included in the locking latch when the locking latch is in the locked position to block rotation of the guide attachment relative to the hopping foot base.
Figure 8A:
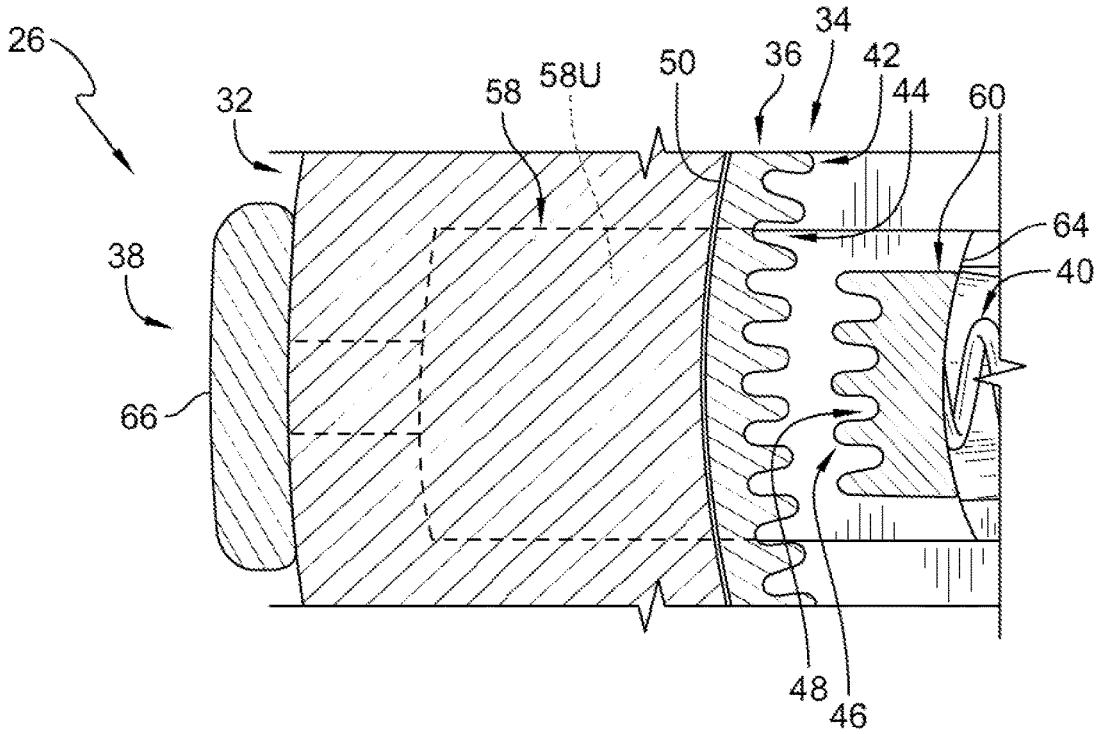
FIG. 8A is a view similar to FIG. 8 showing the locking latch has moved to an unlocked position such that the plurality of locking teeth of the locking latch are spaced apart from the plurality of locking teeth of the lock disk to allow rotation of the guide attachment relative to the hopping foot base.
Figure 9:
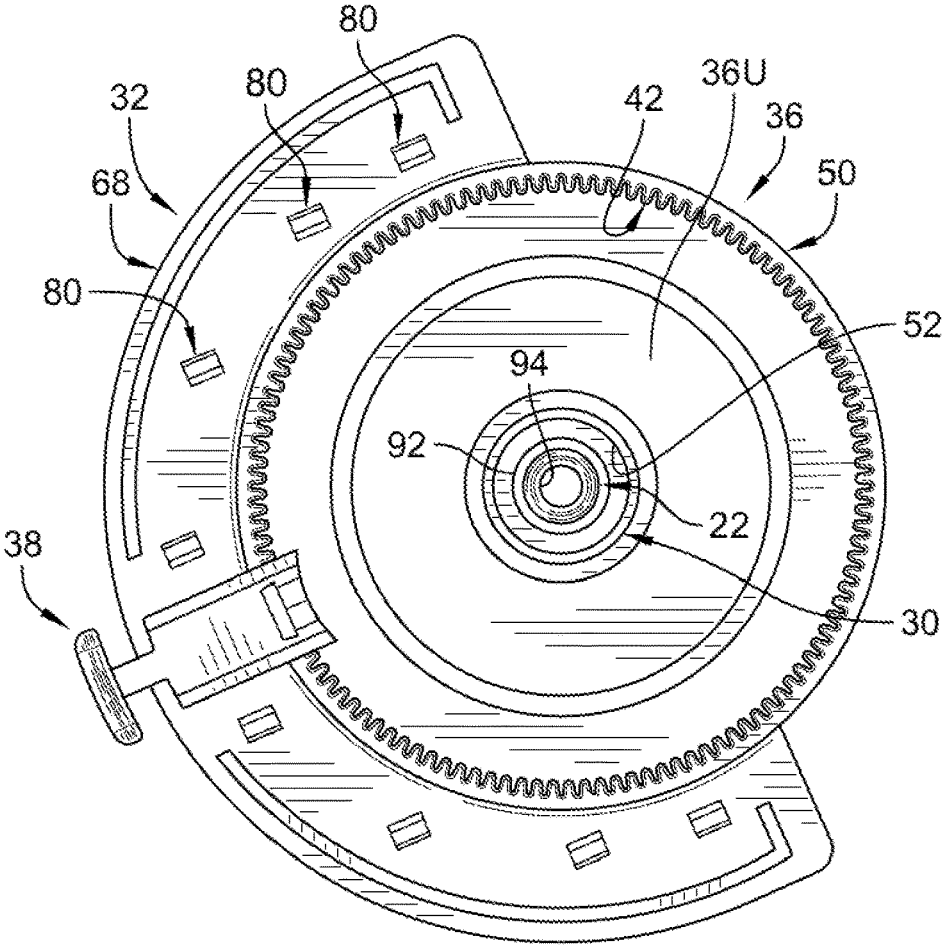
FIG. 9 is cross-section view of the hopping foot assembly of FIG. 3 showing the plurality of locking teeth of the lock disk are spaced apart circumferentially around an axis.

As such, the hopping foot assembly 20 includes the ruler guide 26 to help the user easily guide the hopping foot assembly 20 along the ruler 15. The ruler guide 26 is configured to change between an unlocked configuration as shown in FIGS. 8 and 8A and a locked configuration as shown in FIGS. 7 and 7A to maintain an orientation of the ruler 15 when the ruler guide 26 is engaged with an edge 17 of the ruler 15 that defines a path.

Figure 5:
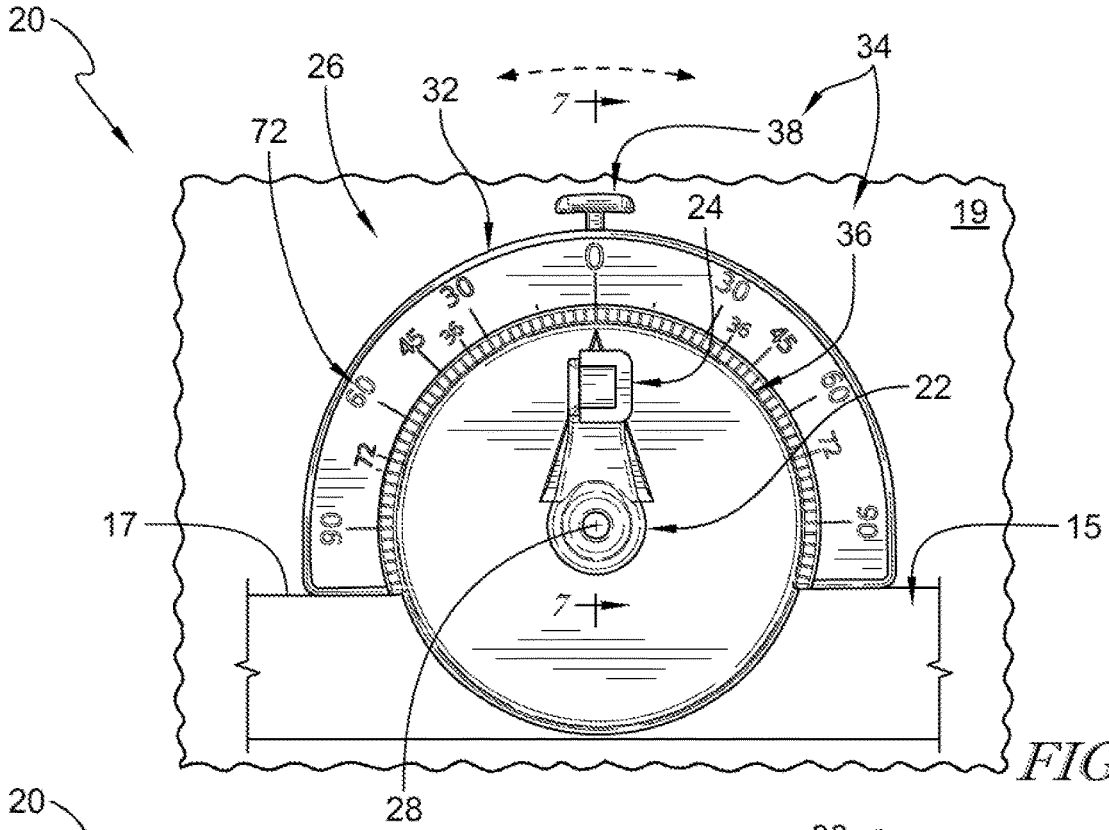
FIG. 5 is a top view of the hopping foot assembly of FIG. 3 showing the rotating ruler guide engaged with the edge of the ruler with the rotating ruler guide in a first orientation.

In the unlocked configuration, the ruler guide 26 is free to rotate about the axis 28 relative to the hopping foot base. This allows the ruler 15 to be moved around the hopping foot assembly 20 to create different paths 21 as suggested in FIGS. 5 and 6. When the ruler guide 26 is in the unlocked configuration, the ruler guide 26 may be rotated to achieve the desired orientation of the ruler 15. As shown in FIG. 5, the dotted arrow suggests the ruler guide 26 is free to rotate in two directions about the axis 28 when in the unlocked configuration.

In locked configuration, the ruler guide 26 is blocked from rotating relative to the hopping foot base 22 to maintain the orientation of the ruler guide 26 and, therefore, the ruler 15. Maintaining engagement of the hopping foot assembly 20 with the edge 17 of the ruler 15 is important for following the path with the needle 18 during use of the sewing machine 10.

The ruler guide 26 comprises a bearing 30, a rotating guide attachment 32, and a locking assembly 34 as shown in FIGS. 3-6. The bearing 30 is coupled to an outer surface of the hopping foot base 22 and configured to rotate about the axis 28. The rotating guide attachment 32 is coupled to the bearing 30 and configured to engage the edge 17 of the ruler 15 so as to align the needle 18 with the path. The locking assembly 34 is configured to change the ruler guide 26 between the unlocked and locked configurations.

The locking assembly 34 comprises a lock disk 36 and a locking latch 38 as shown in FIGS. 3-10. The lock disk 36 is coupled to the hopping foot base 22. The locking latch 38 is coupled to the guide attachment 32. The locking latch 38 is configured to change between a locked position as shown in FIGS. 7 and 7A and an unlocked position as shown in FIGS. 8 and 8A. In the locked position, the locking latch 38 mates with the lock disk 36 to block rotation of the guide attachment 32 relative to the hopping foot base 22. In the unlocked position, the locking latch 38 is spaced apart from the lock disk 36 to allow rotation of the guide attachment 32 relative to the hopping foot base 22.

In the illustrative embodiment, the locking assembly 34 further comprises a bias spring 40 as shown in FIGS. 4 and 7-8A. The bias spring 40 is arranged between the guide attachment 32 and the locking latch 38 to bias the locking latch 38 toward the locked position.

The lock disk 36 is shaped to include a plurality of locking teeth 42, and the locking latch 38 is shaped to include a plurality of locking teeth 46 as shown in FIGS. 7-10. The plurality of locking teeth 42 define a plurality of disk grooves 44 that open radially inward toward the axis 28. The plurality of locking teeth 46 also define a plurality of latch grooves 48 that open radially outward away from the axis 28.

The plurality of locking teeth 42 on lock disk 36 extend into the plurality of latch grooves 48 and the plurality of locking teeth 46 on the locking latch 38 extend into the plurality of disk grooves 44 when the locking latch 38 is in the locked position as shown in FIGS. 7 and 7A. The plurality of locking teeth 42 of the lock disk 36 and the plurality of locking teeth 46 of the locking latch 38 engage to block rotation of the guide attachment 32 relative to the hopping foot base 22.

In the illustrative embodiment, the plurality of locking teeth 42 on the lock disk 36 are spaced apart circumferentially around the axis 28.

Figure 4:
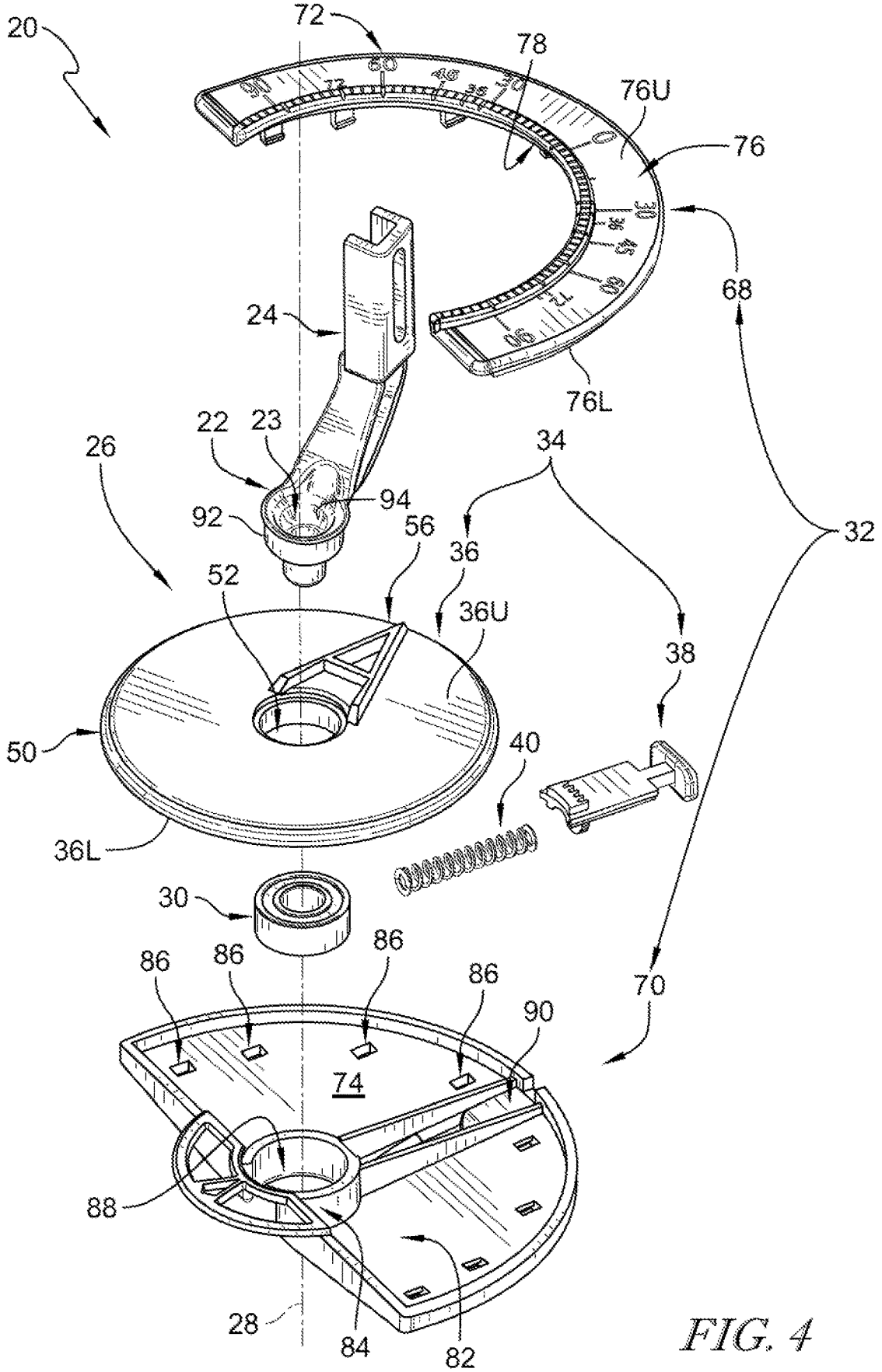
FIG. 4 is an exploded view of the hopping foot assembly of FIG. 3 showing the ruler guide which comprises a bearing configured to be coupled to the hopping foot base and to rotate about the axis, the rotating guide attachment configured to be coupled to the bearing, and a locking assembly that includes a lock disk, a locking latch configured to change between a locked position as shown in FIG. 7 and an unlocked position as shown in FIG. 8, and a bias spring configured to bias the locking latch to the locked position.

The lock disk 36 is shaped to include an upper surface 36U, a lower surface 36L opposite the upper surface 36U, an outer perimeter edge 50 that forms the plurality of locking teeth 42, and a center hole 52 as shown in FIGS. 4, 7, and 8. The outer perimeter edge 50 extends between and interconnects the upper and lower surfaces 36U, 36L. The center hole 52 extends through the upper and lower surfaces 36U, 36L at the axis 28 and the hopping foot base 22 extends into the center hole 52 to couple the lock disk 36 to the hopping foot base 22.

Figure 3:
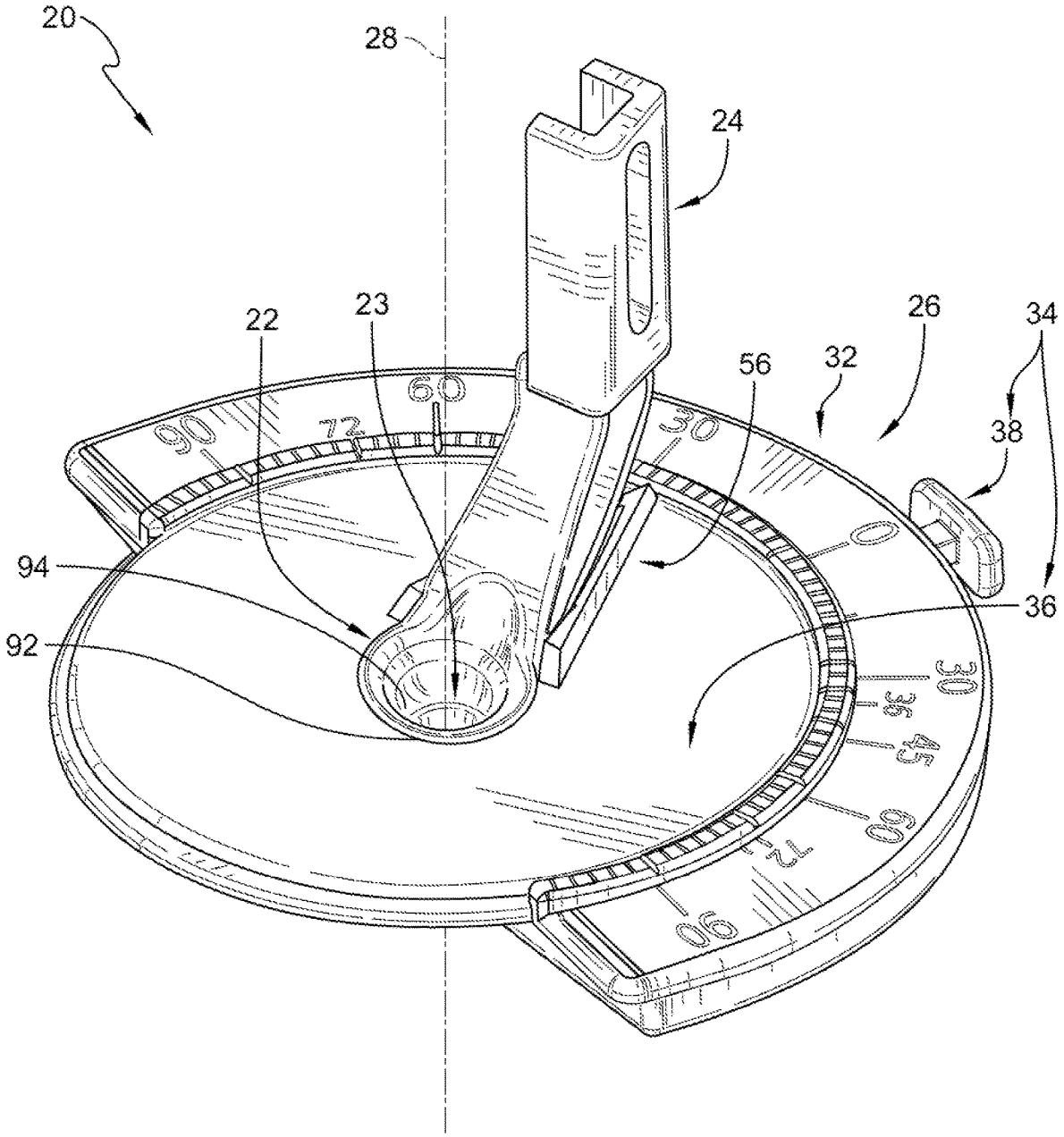
FIG. 3 is a perspective view of the hopping foot assembly of FIG. 2 showing the ruler guide which comprises a pointer and a plurality of angular indicators configured to be aligned with the pointer of the rotating guide to select a path that extends at a predetermined angle.

In the illustrative embodiment, the upper surface 36U of the lock disk 36 is shaped to include a pointer 56 as shown in FIGS. 3 and 4. The pointer 56 is configured to align with one of a plurality of angular indicators 72 formed on the rotating guide attachment 32. The pointer 56 is configured to be aligned with one of the plurality of angular indicators 72 to select the path that extends at a predetermined angle.

To select the predetermined angle, the locking latch 38 is moved to the unlocked position to cause the plurality of locking teeth 46 of the locking latch 38 to be spaced apart from the plurality of locking teeth 42 of the lock disk 36. This allows the rotating guide attachment 32 to rotate about the axis 28. The rotating guide attachment 32 is rotated until the pointer 56 on the lock disk 36 aligns with the desired angular indicator on the guide attachment 32. Then, the locking latch 38 is moved to the locked position to cause the plurality of locking teeth 42 on lock disk 36 to extend into the plurality of latch grooves 48 and the plurality of locking teeth 46 on the locking latch 38 to extend into the plurality of disk grooves 44, thereby blocking rotation of the guide attachment 32.

In the illustrative embodiment, to move the locking latch 38 to the unlocked position, a user engages the locking latch 38 with a force as suggested in FIGS. 7 and 7A. The force overcomes a bias force applied by the bias spring 40 to move the locking latch 38 to the unlocked position. Once the rotating guide attachment 32 is at the predetermined angle, the user releases the locking latch 28, which causes the bias spring 40 to urge the locking latch 38 back to the locked position.

Figure 10:
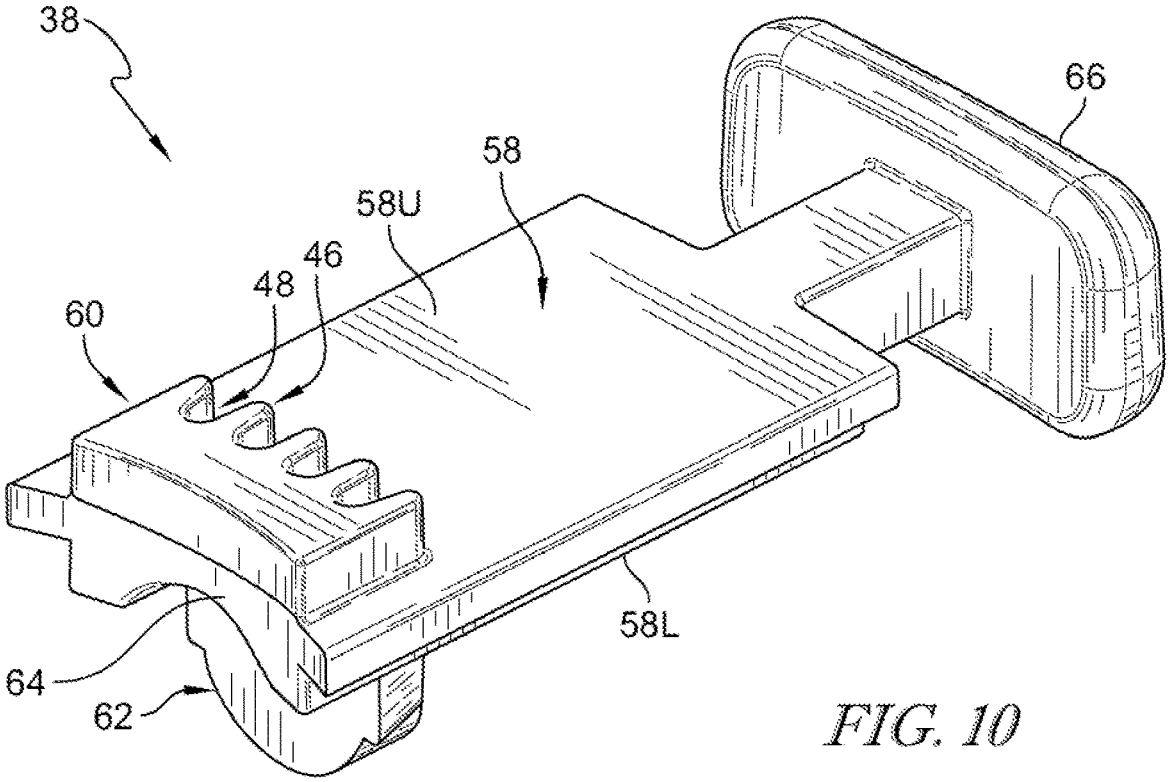
FIG. 10 is a perspective view of the locking latch included in the hopping foot assembly of FIG. 3 showing the locking latch comprises a planar body that extends radially relative to the axis, a first tab that extends axially from a first side of the planar body, and a second tab that extends axially from a second side of the planar body opposite the first side that is configured to be engaged with the bias spring, and further showing the first tab shaped to include the plurality of locking teeth.
Figure 11:
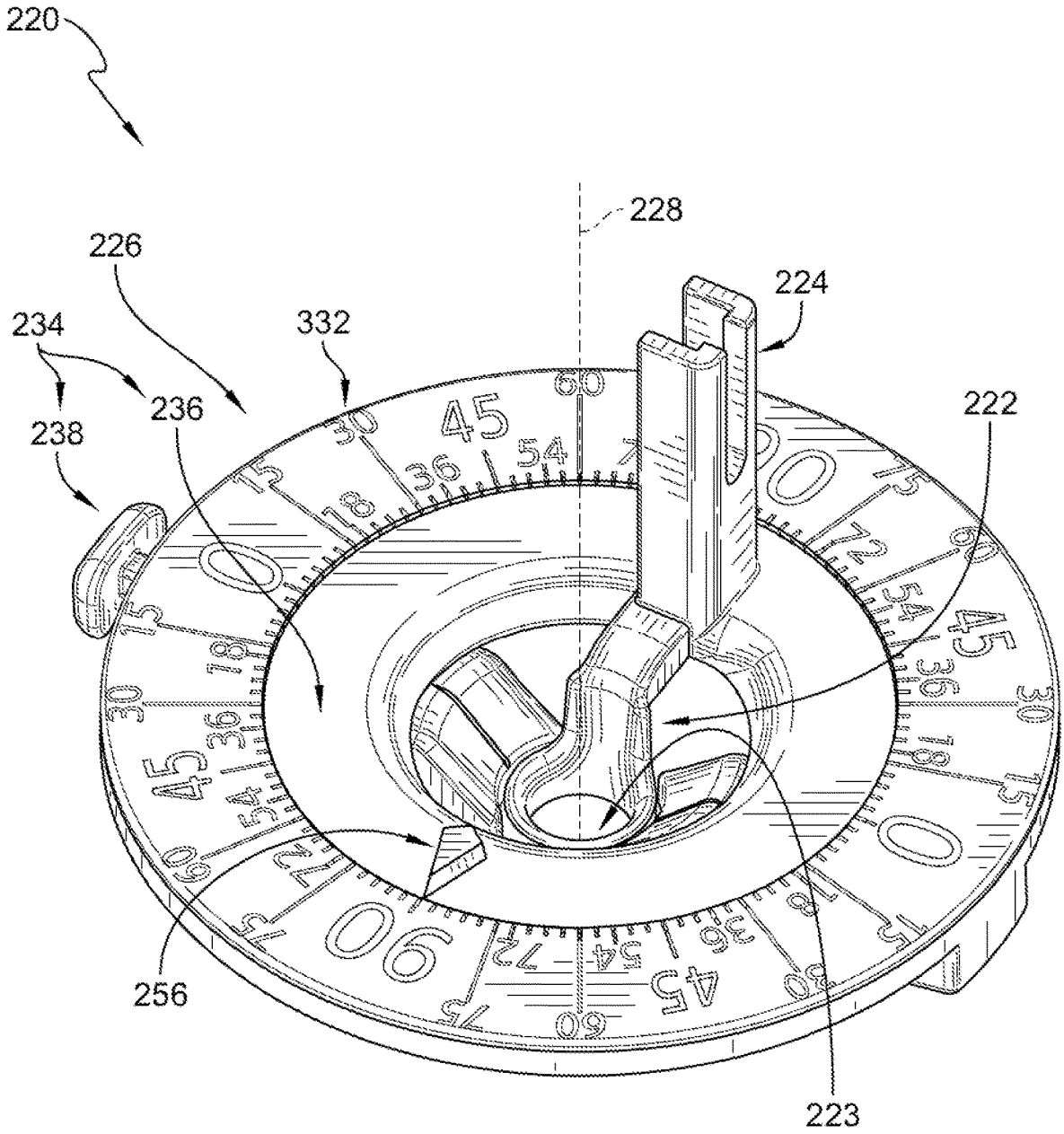
FIG. 11 is view of another embodiment of a hopping foot assembly showing the hopping foot assembly that includes a hopping foot base shaped to include a needle opening that extends axially therethrough relative to an axis of the hopping foot assembly, a hopping foot arm that extends from the hopping foot base and fixes the hopping foot base relative to the sewing machine, and a ruler guide coupled to the hopping foot base that extends circumferentially all the way around the hopping foot base to aid the user in aligning a needle of the sewing machine in a path.

The locking latch 38 is shaped to include a planar body 58, a first tab 60, and a second tab 62 as shown in FIGS. 7-8A and 10. The planar body 58 extends radially relative to the axis. The first tab 60 extends axially from a first side 58U of the planar body 58. The second tab 62 extends axially from a second side 58L of the planar body 58 opposite the first side 58U. In the illustrative embodiment, the first tab 60 of the locking latch 38 is shaped to include the plurality of locking teeth 46 as shown in FIGS. 7, 8 and 10.

The planar body 58 is shaped to define a locking end 64 and an engagement end 66 as shown in FIGS. 7-8A and 10. The first and second tabs 60, 62 extend from the planar body 58 adjacent the locking end 64. The engagement end 66 is spaced apart radially from the locking end 64. The user engages the engagement end 66 of the planar body 58 to move the locking latch 38 between the unlocked and locked positions.

Turning again to the guide attachment 32, the guide attachment 32 includes an upper portion 68 and a lower portion 70 as shown in FIGS. 4, 7, and 8. The lower portion 70 is configured to be coupled to the upper portion 68. In the illustrative embodiment, the upper portion 68 defines the plurality of angular indicators 72.

In the illustrative embodiment, an interior space 74 is defined between the upper and lower portions 68, 70 as shown in FIG. 4. The locking end 64 of the locking latch 38 is located axially between the upper and lower portions 68, 70 of the guide attachment 32 in the interior space 74. The engagement end 66 is located outside of the interior space 74 so that the user may engage the locking latch 38 to move it between the unlocked and locked positions.

The upper portion 68 is shaped to define an upper panel 76, a lip 78, and a plurality of attachment hooks 80 as show in FIGS. 3 and 4. The upper panel 76 extends circumferentially at least partway about the axis 28. The lip 78 extends axially from a first side 76U of the upper panel 76 over the lock disk 36 and circumferentially at least partway about the axis 28. The attachment hooks 80 extend axially from a second side 76L of the upper panel 76 opposite the first side 76U. The attachment hooks 80 are configured to engage the lower portion 70 to couple the upper portion 68 to the lower portion 70. In the illustrative embodiment, the first side 76U of the upper panel 76 and the lip 78 define the plurality of angular indicators 72.

The lower portion 70 is shaped to define a lower panel 76, a flange 84, and attachment notches 86 as shown in FIGS. 3 and 4. The lower panel 76 extends circumferentially at least partway about the axis 28. The flange 84 extends axially from the lower panel 76 toward the lock disk 36 and circumferentially at least partway about the axis 28. The attachment notches 86 extend through the lower panel 76. The notches 86 are configured to receive the attachment hooks 80 to couple the upper portion 68 to the lower portion 70.

The flange 84 defines a center hole 88 as shown in FIGS. 3 and 4. The center hole 88 is concentric with the center hole 52 of the lock disk 36. The flange 84 is coupled to the bearing 30 so that the guide attachment 32 is allowed to rotate about the axis 28 when in the unlocked configuration. The bearing 30 is located in the center hole 88 to rotatably couple the guide attachment 32 to the hopping foot base 22.

In the illustrative embodiment, the bias spring 40 extends between the second tab 62 and the flange 84 as shown in FIGS. 7 and 8. A first end 40A of the bias spring 40 engages the second tab 62 of the locking latch 38, while a second end 40B of the bias spring 40 engages the flange 84.

When the user applies a force to the locking latch 38, the force compresses the bias spring 40 radially between the second tab 62 and the flange 84 relative to the axis 28. The force applied to the locking latch 38 is greater than the bias force applied by the spring to cause the locking latch 38 to translate from the locked position to the unlocked position. When the force is removed, the bias spring 40 urges the locking latch 38 back to the locked position.

In the illustrative embodiment, the lower portion 70 further includes a guide channel 90 as shown in FIG. 4. The bias spring 40 is located in the guide channel 90. The guide channel 90 is configured to maintain the position of the bias spring 40.

Turning again to the hopping foot base 22, the hopping foot base 22 includes outer surface 92, an inner surface 94, and the needle opening 23 as shown in FIGS. 3, 4, 7, 8, and 9. The inner surface 92 is opposite the outer surface 94. The inner surface 92 defines the needle opening 23 that extends axially through the base 22. The bearing 30 is coupled to the outer surface 92 of the hopping foot base 22, and the lock disk 36 is coupled to the outer surface 92 of the hopping foot base 22 in the center hole 52.

In the illustrative embodiment, the hopping foot base 22 is circular as shown in FIGS. 3 and 4. In other embodiments, the hopping foot 22 may have a different shape.

To use the hopping foot assembly 20, the user first selects the orientation of the ruler 15 to get the desired path. If the orientation of the ruler guide 26 does not match the desired orientation of the ruler 15, the user may change the orientation of the ruler guide 26 by applying the force to the locking latch 38 to change the locking latch 38 to the unlocked position and rotating the ruler guide 26 to the desired orientation. The user then stops applying the force to cause the locking latch 38 to change to the locked position blocking rotation of the ruler guide 26 thereby maintaining the desired orientation.

The ruler guide 26 is shown in a first orientation as shown in FIG. 5. The ruler guide 26 is then engaged with the edge 17 of the ruler 15 with the ruler guide 26 in the first orientation. The user then moves the sewing machine 10 along the path while keeping the edge 17 of the ruler 15 engaged with the ruler guide 26. In this way, the needle 18 follows the path and stitches the desired stich line as suggested in FIG. 5.

If the desired path changes direction, the user may change the orientation of the ruler guide 26. To change the orientation of the ruler guide 26 from the first orientation to the second orientation, the user applies force to the locking latch 38 to move the locking latch 38 to the unlocked position so that the ruler guide 26 is in the unlocked configuration.

Figure 6:
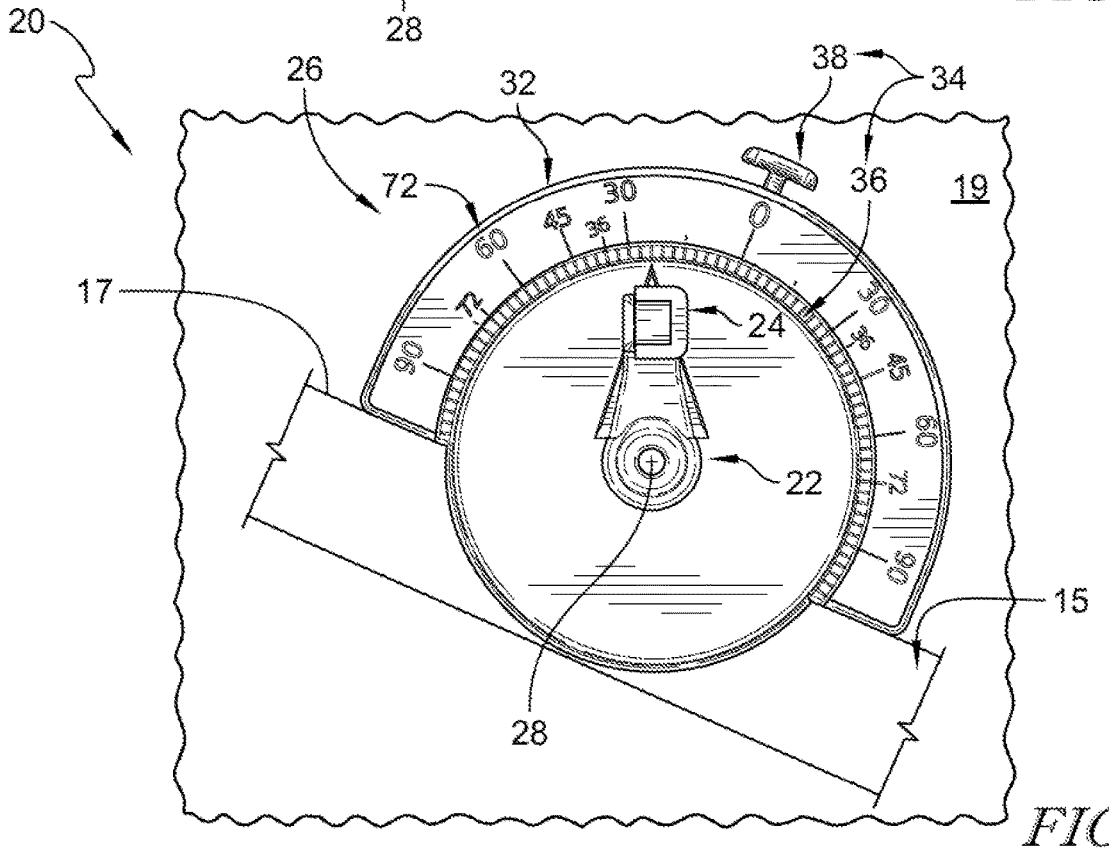
FIG. 6 is a view similar to FIG. 5 showing that the rotating ruler guide has moved to a second orientation such that the rotating ruler guide is at a predetermined angle in the second position compared to the first position.

With the ruler guide 26 in the unlocked configuration, the user may select the new orientation such as a second orientation as shown in FIG. 6. The guide attachment 32 is then rotated about the axis 28 until the pointer 56 on the lock disk 36 aligns with the desired angular indicator on the guide attachment 32 corresponding with the second orientation as shown in FIG. 6. Then, the locking latch 38 is moved to the locked position to cause the plurality of locking teeth 42 on lock disk 36 to extend into the plurality of latch grooves 48 and the plurality of locking teeth 46 on the locking latch 38 to extend into the plurality of disk grooves 44, thereby blocking rotation of the guide attachment 32.

In the illustrative embodiment, to move the locking latch 38 to the unlocked position, a user engages the locking latch 38 with a force as suggested in FIGS. 7 and 7A. The force overcomes a bias force applied by the bias spring 40 to move the locking latch 38 to the unlocked position. Once the rotating guide attachment 32 is at the predetermined angle, the user releases the locking latch 28, which causes the bias spring 40 to urge the locking latch 38 back to the locked position.

Another embodiment of a hopping foot assembly 220 in accordance with the present disclosure is shown in FIGS. 11-17. The hopping foot assembly 220 is substantially similar to the hopping foot assembly 20 shown in FIGS. 1-10 and described herein. Accordingly, similar reference numbers in the 200 series indicate features that are common between the hopping foot assembly 20 and the hopping foot assembly 220. The description of the hopping foot assembly 20 is incorporated by reference to apply to the hopping foot assembly 220, except in instances when it conflicts with the specific description and the drawings of the hopping foot assembly 220.

The hopping foot assembly 220 includes a hopping foot base 222, a hopping foot arm 224, and a ruler guide 226 as shown in FIGS. 11-17. The hopping foot base 222 is shaped to define a needle opening 223 that extends through the base 222 relative to the axis 228. The needle opening 223 is configured to allow the needle 18 to extend into and out of the fabric 19. The hopping foot arm 224 extends axially from the hopping foot base 222 and couples to the presser bar 16 of the sewing machine 10 to fix the hopping foot base 222 relative to the sewing machine 10. The ruler guide 226 is coupled to the hopping foot base 222 and is configured to change between the unlocked configuration and the locked configuration like in the embodiment of FIGS. 7-8A.

The ruler guide 226 includes a rotating guide attachment 232 and a locking assembly 234 comprising a lock disk 236 and a locking latch 238 as shown in FIGS. 11-17. The rotating guide attachment 232 is configured to rotate about the axis 228. The locking assembly 234 is configured to change the ruler guide 236 between the unlocked and locked configurations.

In the illustrative embodiment, lock disk 236 is coupled to the hopping foot base 222, and the rotating guide attachment 232 is rotatably coupled to the lock disk 236 such that the ruler guide 226 does not include a bearing. The locking latch 238 is coupled to the guide attachment 232 and is arranged to extend between the guide attachment 232 and the lock disk 236.

The lock disk 236 is integrally formed with the hopping foot base 222 and hopping foot arm 224 in the illustrative embodiment. The lock disk 236 extends circumferentially about the axis 228. The lock disk 236 is integrally formed with the hopping foot base 222 and the hopping foot arm 224 such that the lock disk 236 is concentric with the hopping foot base 222.

Figure 12:
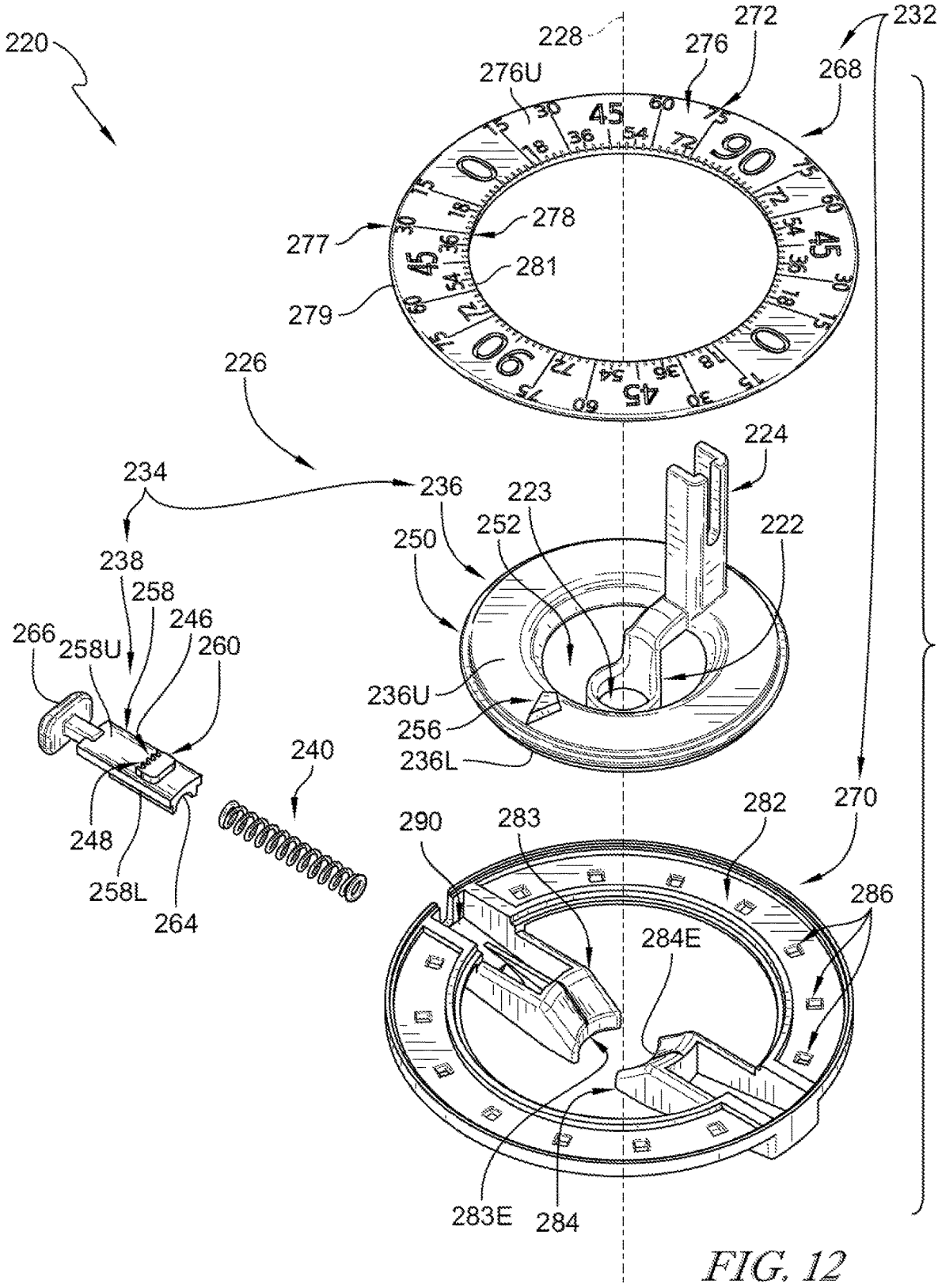
FIG. 12 is an exploded view of the hopping foot assembly of FIG. 11 showing the ruler guide comprises a rotating guide attachment comprising a plurality of angle indicators and a locking assembly that includes a lock disk integrally formed with the hopping foot base, a locking latch configured to change between the locked position as shown in FIG. 15 and the unlocked position, and a bias spring configured to bias the locking latch to the locked position.
Figure 13:
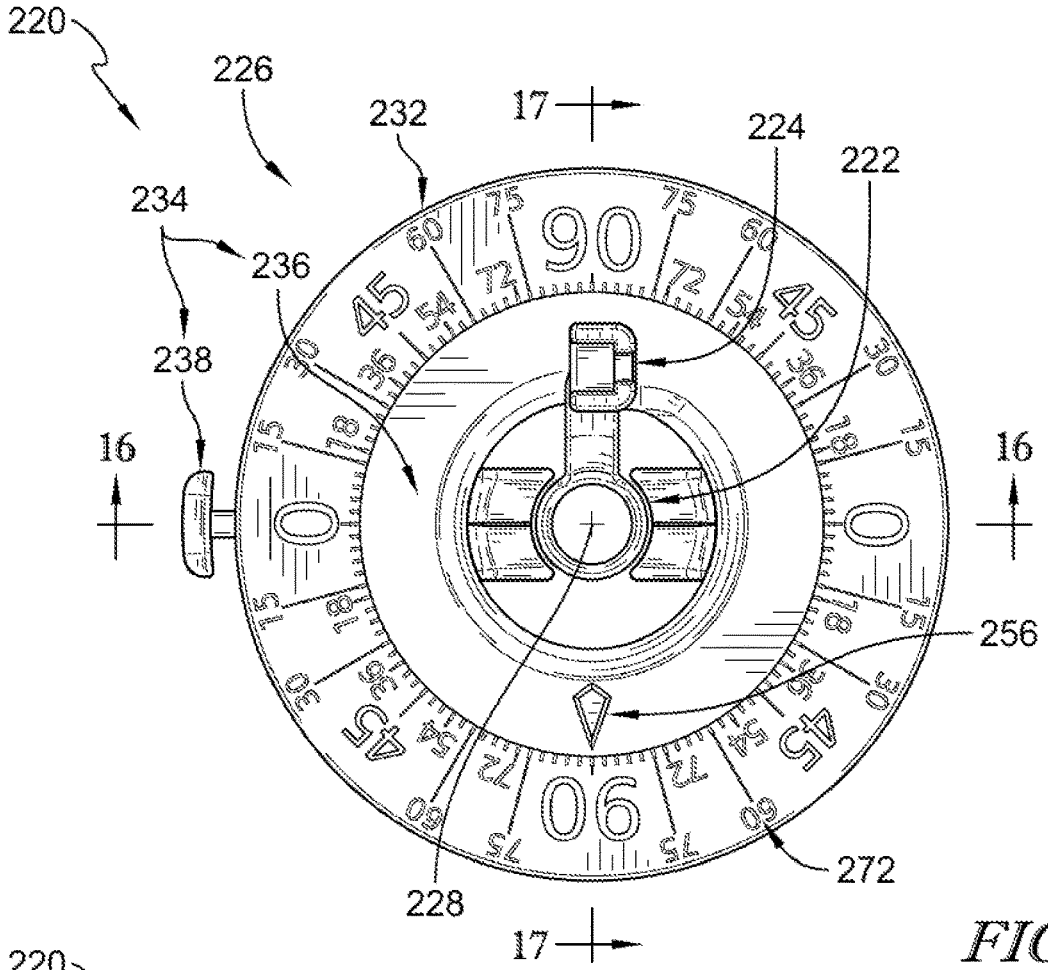
FIG. 13 is a top view of the hopping foot assembly of FIG. 11 showing the rotating ruler guide engaged with the edge of the ruler with the rotating ruler guide in a first orientation.
Figure 14:
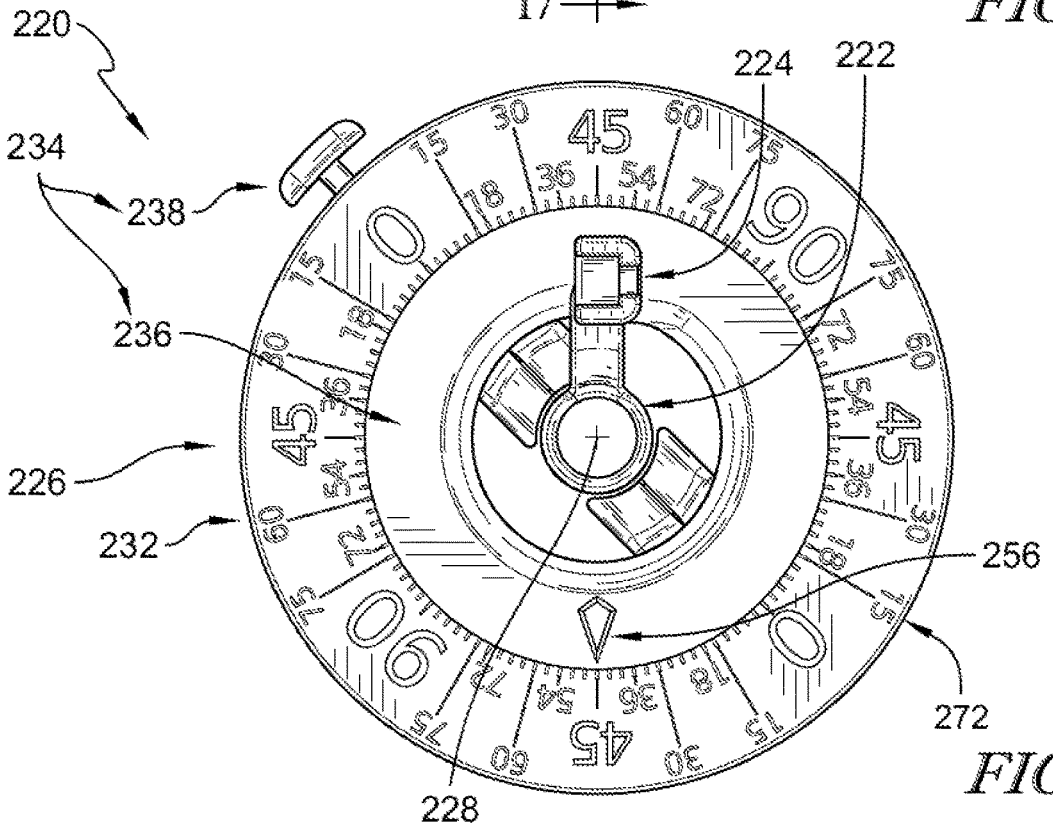
FIG. 14 is a view similar to FIG. 13 showing the rotating ruler guide has moved to a second orientation such that the rotating ruler guide is at a predetermined angle in the second position compared to the first position.
Figure 15:
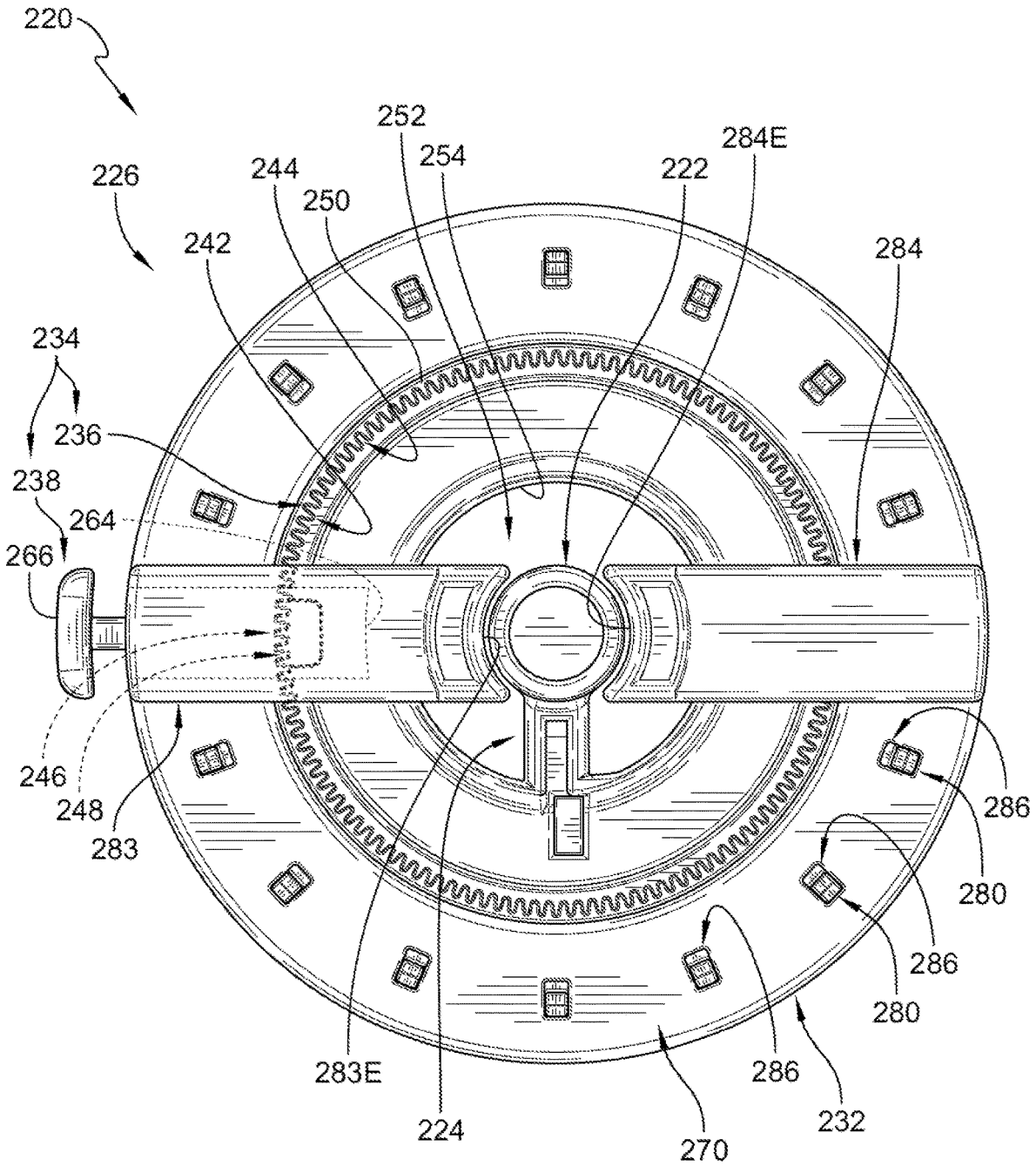
FIG. 15 is a bottom view of the hopping foot assembly of FIG. 11 showing the locking disk is shaped to include a plurality of locking teeth that engage with a plurality of locking teeth included in the locking latch when the locking latch is in the locked position to block rotation of the guide attachment relative to the hopping foot base.

Similar to the embodiment of FIGS. 1-10, the lock disk 236 is shaped to include a plurality of locking teeth 242 and the locking latch 238 is shaped to include a plurality of locking teeth 246 as shown in FIGS. 12 and 15. The plurality of locking teeth 242 define a plurality of disk grooves 244 that open radially inward toward the axis 228. The plurality of locking teeth 246 that define a plurality of latch grooves 248 that open radially outward away from the axis 228.

The plurality of locking teeth 242 on lock disk 236 extend into the plurality of latch grooves 248 and the plurality of locking teeth 246 on the locking latch 238 extend into the plurality of disk grooves 244 when the locking latch 238 is in the locked position as shown in FIG. 15. The plurality of locking teeth 242 of the lock disk 236 and the plurality of locking teeth 246 of the locking latch 238 engage to block rotation of the guide attachment 232 relative to the hopping foot base 222.

In the illustrative embodiment, the locking assembly 234 further comprises a bias spring 240 as shown in FIG. 12. The bias spring 240 is arranged between the guide attachment 232 and the locking latch 238 to bias the locking latch 238 toward the locked position.

The lock disk 236 is shaped to include an upper surface 236U, a lower surface 236L opposite the upper surface 236U, an outer perimeter edge 250 that forms a plurality of locking teeth 242, and a center hole 252 as shown in FIGS. 12 and 15. The outer perimeter edge 250 extends between and interconnects the upper and lower surfaces 236U, 236L. The center hole 252 extends through the upper and lower surfaces 236U, 236L at the axis 228 and defines an inner edge 254 of the lock disk 236.

In the illustrative embodiment, the lock disk 236 is coupled with the hopping foot arm 224 inward of the outer perimeter edge 250. The hopping foot base 222 extends from the inner edge 254 into the center hole 252 such that the inner edge 254 is spaced apart from the hopping foot base 222.

Figure 16:
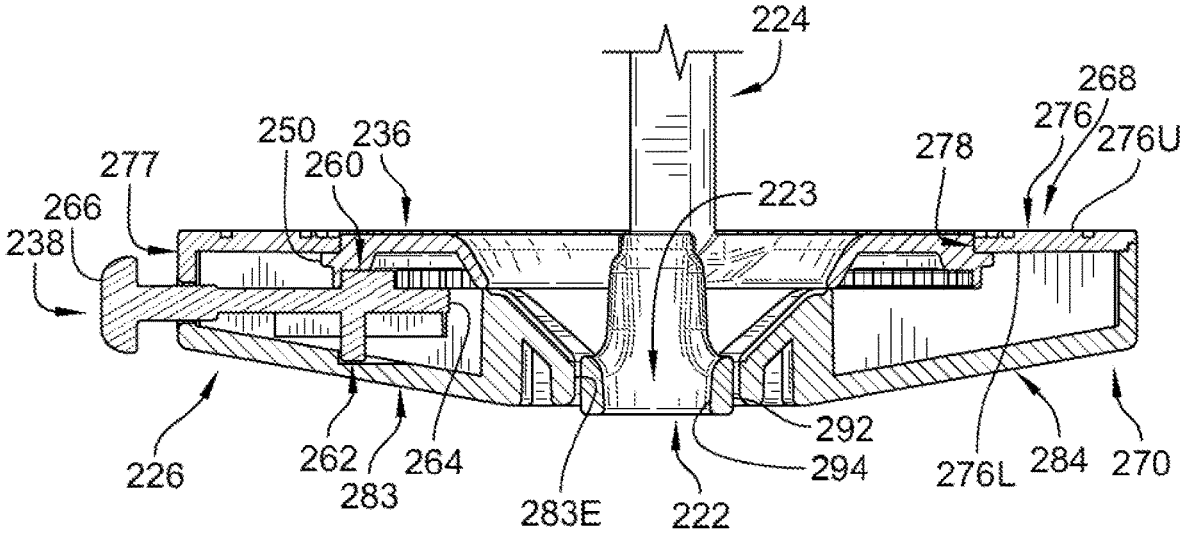
FIG. 16 is a cross-section view of the hopping foot assembly of FIG. 13 taken along line 16-16 showing the ruler guide in the locked configuration such that the locking latch is in locked position in which the locking latch mates with the locking disk to block rotation of the guide attachment relative to the hopping foot base.

The locking latch 238 is shaped to include a planar body 258, a first tab 260, and a second tab 262 as shown in FIGS. 12 and 16. The planar body 258 extends radially relative to the axis 228. The first tab 260 extends axially from a first side 258U of the planar body 258. The second tab 62 extends axially from a second side 258L of the planar body 258 opposite the first side 258U. In the illustrative embodiment, the first tab 260 of the locking latch 238 is shaped to include the plurality of locking teeth 246 as shown in FIGS. 11-17.

The planar body 258 is shaped to define a locking end 264 and an engagement end 266 as shown in FIGS. 12 and 15. The first and second tabs 260, 262 extend from the planar body 258 adjacent the locking end 264. The engagement end 266 is spaced apart radially from the locking end 264. The user engages the engagement end 266 of the planar body 258 to move the locking latch 238 between the unlocked and locked positions.

Turning again to the guide attachment 232, the guide attachment 232 includes an upper portion 268 and a lower portion 270 as shown in FIGS. 12 and 15-17. The lower portion 270 is configured to be coupled to the upper portion 268. In the illustrative embodiment, the upper portion 268 extends circumferentially all the way around the axis 228 and defines the plurality of angular indicators 272.

Figure 17:
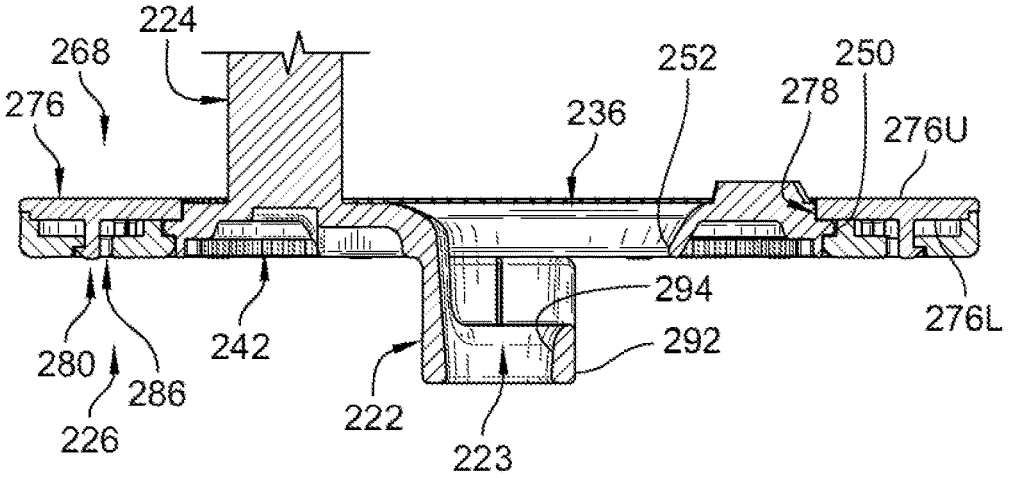
FIG. 17 is a cross-section view of the hopping foot assembly of FIG. 13 taken along line 17-17 showing the guide attachment of the includes an upper portion and a lower portion as that couple together over the lock disk.

The upper portion 268 is shaped to define an upper panel 276, a flange 277, a lip 278, and a plurality of attachment hooks 280 as show in FIGS. 12, 16, and 17. The upper panel 276 extends circumferentially all the way around the axis 228. The flange 277 extends axially from a lower side 276L of the upper panel 276 at an outer perimeter edge 279 of the upper panel 276, while the lip 278 extends axially from an upper side 276U of the upper panel 276 over the lock disk 236 at an inner edge 281 of the upper panel 276. The attachment hooks 280 extend axially from the lower side 276L of the upper panel 276. The attachment hooks 280 are configured to engage the lower portion 270 to couple the upper portion 268 to the lower portion 270. In the illustrative embodiment, the upper side 276U of the upper panel 276 defines the plurality of angular indicators 272.

In the illustrative embodiment, the upper surface 236U of the lock disk 236 is shaped to include a pointer 256 as shown in FIGS. 11-14. The pointer 256 is configured to align with one of a plurality of angular indicators 272 formed on the rotating guide attachment 232. The pointer 256 is configured to be aligned with one of the plurality of angular indicators 272 to select the path that extends at a predetermined angle.

The lower portion 270 is shaped to define a lower panel 282, guide flanges 283, 284, and attachment notches 286 as shown in FIGS. 12 and 15-17. The lower panel 282 extends circumferentially all the way around the axis 228. The guide flanges 283, 284 each extend radially inward from the lower panel 282 toward the hopping foot base 222 on opposite sides of the hopping foot base 222. The terminal ends 283E and 284E of the guide flanges 283, 284 are contoured to match the hopping foot base 222. In the illustrative embodiment, the hopping foot base 222 is circular and the terminal ends 283E and 284E of the guide flanges 283, 284 are contoured to match the circular shape of the hopping foot base 222. The attachment notches 286 extend through the lower panel 282. The notches 286 are configured to receive the attachment hooks 280 to couple the upper portion 268 to the lower portion 270.

In the illustrative embodiment, the lower portion 270 further includes a guide channel 290 as shown in FIG. 12. The bias spring 240 is configured to be located in the guide channel 290. The guide channel 290 is configured to maintain the position of the bias spring 240.

Turning again to the hopping foot base 222, the hopping foot base 222 includes outer surface 292, an inner surface 294, and the needle opening 223 as shown in FIGS. 16 and 17. The inner surface 292 is opposite the outer surface 294. The inner surface 292 defines the needle opening 223 that extends axially through the base 222.

The terminal ends 283E and 284E of the guide flanges 283, 284 are contoured to match the outer surface 292 of the hopping foot base 222 in the illustrative embodiment. The terminal ends 283E and 284E of the guide flanges 283, 284 do not engage the outer surface 292 of the hopping foot base 222 as shown in FIG. 16.

Figure 18:
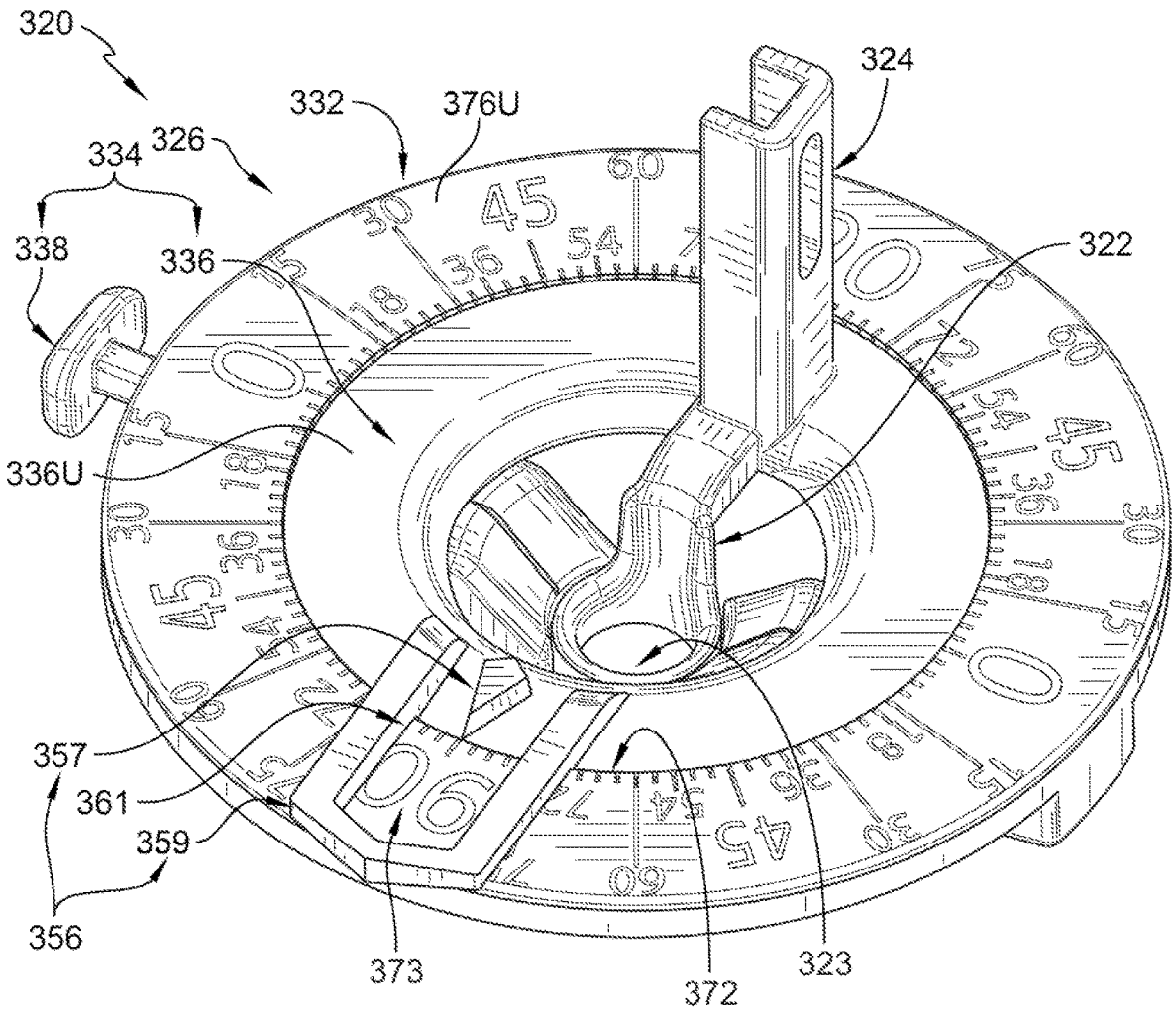
FIG. 18 is a view of another embodiment of a hopping foot assembly showing the hopping foot assembly that includes a hopping foot base shaped to include a needle opening that extends axially therethrough relative to an axis of the hopping foot assembly, a hopping foot arm that extends from the hopping foot base and fixes the hopping foot base relative to the sewing machine, and a ruler guide coupled to the hopping foot base that extends circumferentially all the way around the hopping foot base to aid the user in aligning a needle of the sewing machine in a path.

Another embodiment of a hopping foot assembly 320 in accordance with the present disclosure is shown in FIG. 18. The hopping foot assembly 320 is substantially similar to the hopping foot assembly 20 shown in FIGS. 1-10 and the hopping foot assembly 220 as shown in FIGS. 11-17 and described herein. Accordingly, similar reference numbers in the 300 series indicate features that are common between the hopping foot assemblies 20, 220 and the hopping foot assembly 320. The description of the hopping foot assembly 20 and the hopping foot assembly 220 is incorporated by reference to apply to the hopping foot assembly 320, except in instances when it conflicts with the specific description and the drawings of the hopping foot assembly 320.

The hopping foot assembly 320 includes a hopping foot base 322 is shaped to define a needle opening 323, a hopping foot arm 324 the extends axially from the hopping foot base 322 and couples to the presser bar 16 of the sewing machine 10, and a ruler guide 326 as shown in FIG. 18. The ruler guide 326 is coupled to the hopping foot base 322 and is configured to change between the unlocked configuration and the locked configuration like in the embodiment of FIGS. 7-8A.

The ruler guide 326 includes a rotating guide attachment 332 configured to rotate about the axis and a locking assembly 334 configured to change the ruler guide 326 between the unlocked and locked configurations as shown in FIG. 18. The locking assembly 334 comprises a lock disk 336 and a locking latch 338. The lock disk 336 is shaped to include a pointer 356 configured to align with one of a plurality of angular indicators 372 formed on the rotating guide attachment 332 as shown in FIG. 18.

The pointer 356 includes an arrow 357 and a viewfinder 359 as shown in FIG. 18. The arrow 357 is formed on an upper surface 336U of the lock disk 336. The viewfinder 359 extends radially outwardly from the lock disk 336 over the guide attachment 332.

The arrow 357 is configured to be aligned with one of the plurality of angular indicators 372 on an upper side 376U of the guide attachment 332 to select the path that extends at a predetermined angle. The viewfinder 359 is configured to frame the angle numbers 373 formed on the upper side 376U of the guide attachment 332. The arrow 357 is arranged so as to point within a viewfinder aperture 361 formed by the viewfinder 359 as shown in FIG. 18.

The viewfinder aperture 361 formed by the by the viewfinder 359 is sized to the angle number 373 corresponding to the angular indicator 372 aligned with the arrow 357 as shown in FIG. 18. The user can thereby easily see the desired angle to be selected while rotating the guide attachment 332.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A hopping foot assembly for a sewing machine having a needle, the hopping foot assembly comprising:

a circular hopping foot base shaped to include an outer surface and an inner surface that defines a needle opening that extends axially therethrough relative to an axis to allow the needle to extend into and out of fabric during use of the sewing machine, a hopping foot arm that extends axially from the hopping foot base relative to the axis and configured to be coupled to the sewing machine to fix the hopping foot base relative to the sewing machine, and a ruler guide coupled to the hopping foot base and configured to change between an unlocked configuration in which the ruler guide is free to rotate in two directions about the axis relative to the hopping foot base and a locked configuration in which the ruler guide is blocked from rotating relative to the hopping foot base so that an orientation of the ruler guide is maintained when the ruler guide is engaged with an edge of a ruler to allow a user to follow a path with the needle of the sewing machine during use of the sewing machine.

2. The hopping foot assembly of claim 1, wherein the rotating ruler guide comprises:

a bearing coupled to the outer surface of the hopping foot base and configured to rotate about the axis, a rotating guide attachment coupled to the bearing and configured to engage the edge of the ruler so as to align the needle with the path, and a locking assembly comprising:

a lock disk coupled to the hopping foot base, and a locking latch coupled to the guide attachment and configured to change between a locked position in which the locking latch mates with the lock disk to block rotation of the guide attachment relative to the hopping foot base and an unlocked position in which the locking latch is spaced apart from the lock disk to allow rotation of the guide attachment relative to the hopping foot base.

3. The hopping foot assembly of claim 2, wherein the locking assembly further comprises a bias spring arranged between the guide attachment and the locking latch to bias the locking latch toward the locked position.

4. The hopping foot assembly of claim 2, wherein the lock disk is shaped to include a pointer, and the rotating guide attachment is shaped to include a plurality of angular indicators configured to be aligned with the pointer of the rotating guide to select a path that extends at a predetermined angle.

5. A hopping foot assembly for a sewing machine having a needle, the hopping foot assembly comprising:

a circular hopping foot base shaped to include an outer surface and an inner surface that defines a needle opening that extends axially therethrough relative to an axis to allow the needle to extend into and out of fabric during use of the sewing machine, a hopping foot arm that extends axially from the hopping foot base relative to the axis and configured to be coupled to the sewing machine to fix the hopping foot base relative to the sewing machine, and a ruler guide coupled to the hopping foot base and configured to change between an unlocked configuration in which the ruler guide is free to rotate about the axis relative to the hopping foot base and a locked configuration in which the ruler guide is blocked from rotating relative to the hopping foot base so that an orientation of the ruler guide is maintained when the ruler guide is engaged with an edge of a ruler to allow a user to follow a path with the needle of the sewing machine during use of the sewing machine, wherein the rotating ruler guide comprises:

a bearing coupled to the outer surface of the hopping foot base and configured to rotate about the axis, a rotating guide attachment coupled to the bearing and configured to engage the edge of the ruler so as to align the needle with the path, and a locking assembly comprising:

a lock disk coupled to the hopping foot base, and a locking latch coupled to the guide attachment and configured to change between a locked position in which the locking latch mates with the lock disk to block rotation of the guide attachment relative to the hopping foot base and an unlocked position in which the locking latch is spaced apart from the lock disk to allow rotation of the guide attachment relative to the hopping foot base, wherein the lock disk is shaped to include a plurality of locking teeth that define a plurality of disk grooves that open radially inward toward the axis, wherein the locking latch is shaped to include a plurality of locking teeth that define a plurality of latch grooves that open radially outward away from the axis, and wherein the plurality of locking teeth on lock disk extend into the plurality of latch grooves, and the plurality of locking teeth on the locking latch extend into the plurality of disk grooves when the locking latch is in the locked position to block rotation of the guide attachment relative to the hopping foot base.

6. The hopping foot assembly of claim 5, wherein the plurality of locking teeth on the lock disk are spaced apart circumferentially around the axis.

7. The hopping foot assembly of claim 6, wherein the locking assembly further comprises a bias spring arranged between the guide attachment and the locking latch to bias the locking latch toward the locked position.

8. The hopping foot assembly of claim 7, wherein the locking latch comprises:

a planar body that extends radially relative to the axis, a first tab that extends axially from a first side of the planar body, the first tab shaped to include the plurality of locking teeth, and a second tab that extends axially from a second side of the planar body opposite the first side and the second tab engaged with the bias spring.

9. The hopping foot assembly of claim 5, wherein the lock disk is shaped to include a pointer and the rotating guide attachment is shaped to include a plurality of angular indicators configured to be aligned with the pointer of the rotating guide to select a path that extends at a predetermined angle.

10. The hopping foot assembly of claim 1, wherein the rotating ruler guide comprises:

a lock disk coupled to the hopping foot base, a rotating guide attachment coupled to the lock disk to rotate about the axis and configured to engage the edge of the ruler so as to align the needle with the path, and a locking latch arranged to extend between the guide attachment and the lock disk and configured to change between a locked position in which the locking latch mates with the lock disk to block rotation of the guide attachment relative to the hopping foot base and an unlocked position in which the locking latch is spaced apart from the lock disk to allow rotation of the guide attachment relative to the hopping foot base.

11. The hopping foot assembly of claim 10, wherein the lock disk is shaped to include a pointer and the rotating guide attachment is shaped to include a plurality of angular indicators configured to be aligned with the pointer of the rotating guide to select a path that extends at a predetermined angle.

12. The hopping foot assembly of claim 11, wherein the locking assembly further comprises a bias spring arranged between the guide attachment and the locking latch to bias the locking latch toward the locked position.

13. A hopping foot assembly for a sewing machine having a needle, the hopping foot assembly comprising:

a hopping foot base shaped to include a needle opening that extends axially therethrough relative to an axis, a hopping foot arm that extends axially from the hopping foot base and configured to be coupled to the sewing machine to fix the hopping foot base relative to the sewing machine, and a ruler guide coupled to the hopping foot base and configured to change between an unlocked configuration in which the ruler guide is free to rotate in two directions about the axis relative to the hopping foot base and a locked configuration in which the ruler guide is blocked from rotating relative to the hopping foot base.

14. The hopping foot assembly of claim 13, wherein the rotating ruler guide comprises:

a bearing coupled to the outer surface of the hopping foot base and configured to rotate about the axis, a rotating guide attachment coupled to the bearing and configured to engage the edge of the ruler so as to align the needle with the path, and a locking assembly comprising:

a lock disk coupled to the hopping foot base, and a locking latch coupled to the guide attachment and configured to change between a locked position in which the locking latch mates with the lock disk to block rotation of the guide attachment relative to the hopping foot base and an unlocked position in which the locking latch is spaced apart from the lock disk to allow rotation of the guide attachment relative to the hopping foot base.

15. The hopping foot assembly of claim 14, wherein the lock disk is shaped to include a plurality of locking teeth, the locking latch is shaped to include a plurality of locking teeth, and the plurality of locking teeth on lock disk engage the plurality of locking teeth on the locking latch when the locking latch is in the locked position to block rotation of the guide attachment relative to the hopping foot base.

16. The hopping foot assembly of claim 15, wherein the plurality of locking teeth on lock disk define a plurality of disk grooves that open radially inward toward the axis, the plurality of locking teeth on the locking latch define a plurality of latch grooves that open radially outward away from the axis, and the plurality of locking teeth on lock disk extend into the plurality of latch grooves and the plurality of locking teeth on the locking latch extend into the plurality of disk grooves when the locking latch is in the locked position.

17. The hopping foot assembly of claim 15, wherein the plurality of locking teeth on the lock disk are spaced apart circumferentially around the axis.

18. The hopping foot assembly of claim 13, wherein the locking assembly further comprises a bias spring arranged between the guide attachment and the locking latch to bias the locking latch toward the locked position.

19. The hopping foot assembly of claim 13, wherein the lock disk is shaped to include a pointer and the rotating guide attachment is shaped to include a plurality of angular indicators configured to be aligned with the pointer of the rotating guide to select a path that extends at a predetermined angle.

20. The hopping foot assembly of claim 13, wherein the rotating ruler guide comprises:

a lock disk coupled to the hopping foot base, a rotating guide attachment coupled to the lock disk to rotate about the axis and configured to engage the edge of the ruler so as to align the needle with the path, and a locking latch arranged to extend between the guide attachment and the lock disk and configured to change between a locked position in which the locking latch mates with the lock disk to block rotation of the guide attachment relative to the hopping foot base and an unlocked position in which the locking latch is spaced apart from the lock disk to allow rotation of the guide attachment relative to the hopping foot base.

* * * * *